US011306953B2

(12) United States Patent
Moriyama et al.

(10) Patent No.: US 11,306,953 B2
(45) Date of Patent: Apr. 19, 2022

(54) COMPRESSOR AND REFRIGERATION CYCLE APPARATUS

(71) Applicant: Mitsubishi Electric Corporation, Chiyoda-ku (JP)

(72) Inventors: Takashi Moriyama, Chiyoda-ku (JP); Hiroki Murakami, Chiyoda-ku (JP); Hiroshi Yamamoto, Chiyoda-ku (JP); Wahei Shingu, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 195 days.

(21) Appl. No.: 16/461,459

(22) PCT Filed: May 19, 2017

(86) PCT No.: PCT/JP2017/018802
§ 371 (c)(1),
(2) Date: May 16, 2019

(87) PCT Pub. No.: WO2018/135013
PCT Pub. Date: Jul. 26, 2018

(65) Prior Publication Data

US 2019/0346190 A1 Nov. 14, 2019

(30) Foreign Application Priority Data

Jan. 18, 2017 (JP) ..... JP2017-006643

(51) Int. Cl.
*F25B 43/02* (2006.01)
*F04C 29/02* (2006.01)
(Continued)

(52) U.S. Cl.
CPC ..... *F25B 43/02* (2013.01); *F04B 39/04* (2013.01); *F04C 18/023* (2013.01);
(Continued)

(58) Field of Classification Search
CPC ..... F25B 43/02; F25B 1/04; F04C 29/026; F04C 18/0207; F04C 18/0215; F04C 18/023; F04B 39/04
See application file for complete search history.

(56) References Cited

U.S. PATENT DOCUMENTS 5,366,352 A * 11/1994 Deblois ..... F04B 39/066 417/292
5,772,416 A * 6/1998 Caillat ..... F01C 1/0215 418/55.6

(Continued)

FOREIGN PATENT DOCUMENTS

EP 2 884 106 A1 6/2015
JP 6-10859 A 1/1994

(Continued)

OTHER PUBLICATIONS

Chinese Office Action dated Jun. 16, 2020 in Chinese patent application No. 201780076980.5.

(Continued)

*Primary Examiner* — Christopher S Bobish
(74) *Attorney, Agent, or Firm* — Xsensus LLP

(57) ABSTRACT

A compressor includes a container provided with an oil reservoir which is provided at a bottom portion of the container to allow oil to be collected in the oil reservoir. In the container, an electric motor mechanism, a rotary shaft, a compression mechanism, and a frame which fixes the compression mechanism to the container are provided. In the frame, a suction port is formed to cause refrigerant having flowed into the space to flow into the compression mechanism, and each of a suction portion and a connection port of the suction pipe, is located at a position which is higher than or the same as the level of the rotary shaft as seen in a rotation axial direction A rib in a first flow passage extends
(Continued)

downwards in the direction of gravity from the connection port, extends through an area located above the oil reservoir, and reaches the suction port.

18 Claims, 15 Drawing Sheets

(51) Int. Cl.
*F25B 1/04* (2006.01)
*F04C 18/02* (2006.01)
*F04B 39/04* (2006.01)

(52) U.S. Cl.
CPC ..... *F04C 18/0207* (2013.01); *F04C 18/0215* (2013.01); *F04C 29/02* (2013.01); *F04C 29/026* (2013.01); *F25B 1/04* (2013.01)

(56) References Cited

U.S. PATENT DOCUMENTS 6,896,496 B2 * 5/2005 Haller ..... F04C 18/0215 184/6.17
7,018,183 B2 * 3/2006 Haller ..... F04C 29/126 137/856
7,018,184 B2 * 3/2006 Skinner ..... F04C 23/008 418/55.1
7,063,523 B2 * 6/2006 Skinner ..... F04C 18/0215 184/6.17
7,748,969 B2 * 7/2010 Um ..... F04C 18/0215 418/55.6
2004/0057848 A1 3/2004 Haller et al.

FOREIGN PATENT DOCUMENTS

JP 2001-165065 A 6/2001
JP 2001-207980 A 8/2001
JP 2015-132254 A 7/2015

OTHER PUBLICATIONS

Extended European Search Report dated Nov. 14, 2019 in European Patent Application No. 17892922.0, 7 pages.
European Office Action dated Mar. 15, 2021 issued in corresponding European patent application No. 17892922.0.
International Search Report dated Aug. 1, 2017 in PCT/JP2017/018802 filed on May 19, 2017.
Chinese Office Action dated Jun. 16, 2020 issued in Chinese patent application No. 201780076980.5.

* cited by examiner

Comparative Example

Comparative Example

Comparative Example

Comparative Example

Comparative Example

Comparative Example

COMPRESSOR AND REFRIGERATION CYCLE APPARATUS

TECHNICAL FIELD

The present invention relates to a horizontal compressor and a refrigeration cycle apparatus including the compressor as a component.

BACKGROUND ART

In an existing compressor, there is a case where oil which is being returned to an oil reservoir provided in a bottom portion of the container after lubricating sliding portions in the compressor is mixed into refrigerant sucked into a container of the compressor through a suction pipe, and the refrigerant in which the oil is mixed is then compressed in a compression chamber and discharged to the outside of the compressor. If the oil is continuously discharged in this state, the oil stored in the oil reservoir continuously decreases, as a result which oil for the sliding portions may be in short supply, and the sliding portions may not be sufficiently lubricated. Patent Literature 1 discloses that refrigerant having flowed into a container through a suction pipe is made to strike a partition plate, to thereby separate oil from the refrigerant, and the oil is returned to an oil reservoir, to thereby reduce decreasing of oil in the oil reservoir.

CITATION LIST

Patent Literature

Patent Literature 1: Japanese Unexamined Patent Application Publication No. 2001-207980

SUMMARY OF INVENTION

Technical Problem

Patent Literature 1 discloses a so-called vertical compressor in which a container is set upright. However, for example, in the case where space for a compressor does not have a sufficient height, a horizontal compressor may be used instead of the vertical compressor. In the vertical compressor, the oil reservoir is formed in a bottom portion of the container, whereas in the horizontal compressor, the oil reservoir is formed in a cylindrical side surface portion. Therefore, the oil stored in the oil reservoir easily comes into contact with a rotor of a motor, and thus easily flies into the container because of the rotation of the rotor of the motor. Also, refrigerant gas flowing from a suction pipe to a suction port violently disturbs a surface of the oil stored in the oil reservoir, and the oil thus easily flies off into the container. In such a manner, if flying off into the container, the oil is easily sucked along with the flowing refrigerant gas into the compression chamber, and, as a result the oil is discharged to the outside of the compressor, thus increasing the amount of discharged oil.

Patent Literature 1 considers that the oil is separated from the refrigerant having flowed into the container through the suction pipe, but does not consider that oil flying off from the oil reservoir is mixed into the refrigerant, and as a result the amount of discharged oil increases. It is therefore necessary to take countermeasures against increasing of the amount of discharged oil.

The present invention has been made to solve the above problems, and an object of the invention is to provide a compressor and a refrigeration cycle apparatus, which can reduce the amount of discharge of oil in the case where the compressor is set to be laid in the horizontal direction.

Solution to Problem

A compressor of an embodiment of the present invention includes: a container provided with an oil reservoir which is provided at a bottom portion of the container to allow oil to be collected in the oil reservoir; an electric motor mechanism supported in the container; a rotary shaft which receives a rotary driving force of the electric motor mechanism; a compression mechanism provided in the container to compress refrigerant by rotation of the rotary shaft; a frame provided between the electric motor mechanism and the compression mechanism to fix the compression mechanism to the container; and a suction pipe connected to the container to communicate with space between the frame and the electric motor mechanism, and thus allow the refrigerant to flow into the space. The frame is provided with a suction port formed therein to allow that refrigerant having flowed into the space to flow into the compression mechanism. Each of the suction port and a connection port of the suction pipe that connects with the container is provided at a position which is higher than or the same as the level of the rotary shaft, as seen in a rotary shaft direction of the rotary shaft, with the container set such that the rotary shaft is inclined relative to the direction of gravity or is laid horizontal. A rib is provided in a first flow passage which extends downwards in the direction of gravity from the connection port, extends through an area located above the oil reservoir, and reaches the suction port.

A refrigeration cycle apparatus of an embodiment of the present invention is provided with the above compressor.

Advantageous Effects of Invention

In an embodiment of the present invention, a rib is provided in a first flow passage which extends downwards in the direction of gravity from a connection port of a suction pipe that connects with a container, extends through an area located above an oil reservoir, and reaches a suction port. Therefore, flowing refrigerant gas strikes the rib, thereby reducing the flow rate of the refrigerant gas, and also reducing flying off of oil droplets from an oil surface of oil in the oil reservoir. Furthermore, even if oil flies off from the oil reservoir, the refrigerant along with the oil contained therein strikes the rib, whereby the oil can be separated from the refrigerant gas. By virtue of the above configuration, even in the case where the compressor is laid horizontally, it is possible to reduce the amount of oil to be discharged from the compressor after the refrigerant gas is sucked into the compression mechanism through the suction port.

DESCRIPTION OF EMBODIMENTS

Figure 1:
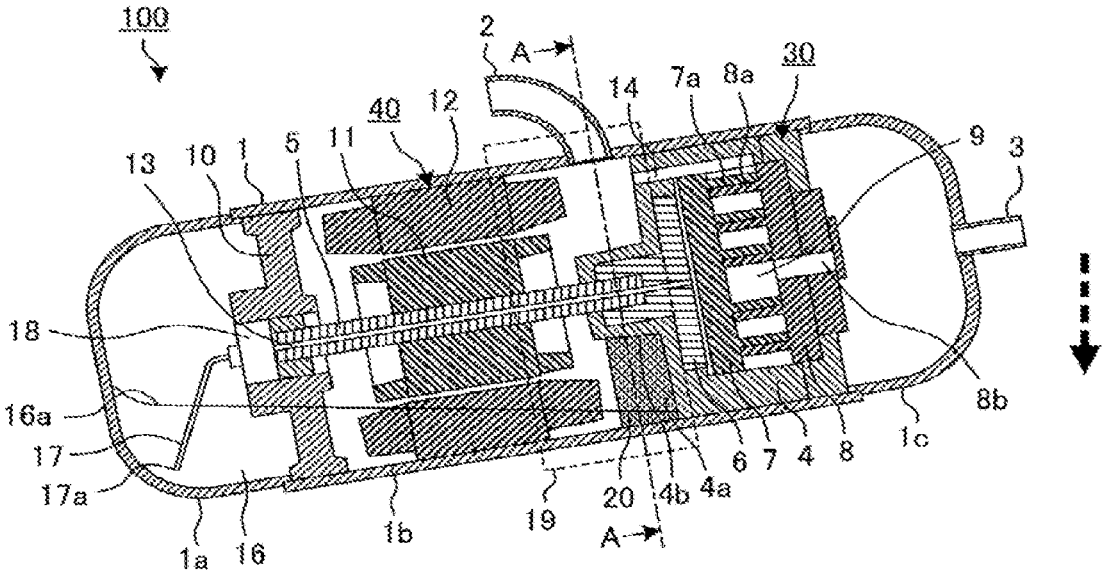
FIG. 1 is a schematic cross-sectional view illustrating a configuration of a compressor 100 according to embodiment 1 of the present invention.

A refrigeration cycle apparatus according to an embodiment of the present invention will be described with reference to the drawings, etc. It should be noted that in each of the following figures including FIG. 1, components which are the same as or correspond to those in a previous figure are denoted by the same reference numerals, and the same is true of the entire text of the specification with respect to all the embodiments. In addition, the forms of the components described throughout the specification are merely examples and are not limited to the forms described in the specification. It should be noted that in the following figures in including FIG. 1, the relationship in dimension between components and the shapes of the components may be different from the actual ones.

Embodiment 1

A compressor 100 according to embodiment 1 of the present invention will be described below. FIG. 1 is a schematic cross-sectional view illustrating a configuration of the compressor 100 according to embodiment 1 of the present invention. A dashed arrow in FIG. 1 indicates the direction of gravity. The compressor 100 according to embodiment 1 is a component of a refrigeration cycle apparatus for use in, for example, an air-conditioning device, a refrigeration device, a refrigerator, a freezer, an automatic vending machine or a water heater. The compressor 100 according to embodiment 1 is a horizontal scroll compressor. The horizontal scroll compression is a compressor provided such that a rotary shaft 5 to be described later is inclined relative to the direction of gravity or is set horizontal.

As illustrated in FIG. 1, the compressor 100 according to embodiment 1 includes a compression mechanism 30 which compresses refrigerant, an electric motor mechanism 40 which drives the compression mechanism 30, the rotary shaft 5 which receive a rotary driving force of the electric motor mechanism 40, and transmits it to the compression mechanism 30, and a container 1 which houses the compression mechanism 30 and the electric motor mechanism 40. In the container 1, a frame 4 for fixing the compression mechanism 30 to the container 1 is provided between the compression mechanism 30 and the electric motor mechanism 40.

The compression mechanism 30 includes a power conversion mechanism 6, an orbiting scroll 7 which is attached to the power conversion mechanism 6, and is moved, and a fixed scroll 8 fixed to the frame 4. The power conversion mechanism 6 is attached to the rotary shaft 5 which is to be rotated by the electric motor mechanism 40, and is provided to convert the rotary driving force to a compression driving force. The orbiting scroll 7 includes a scroll lap 7*a* formed on a surface of the orbiting scroll 7, and the fixed scroll 8 includes a scroll lap 8*a* formed on a surface of the fixed scroll 8. The orbiting scroll 7 and the fixed scroll 8 are assembled such that the scroll laps 7*a* and 8*a* mesh with each other. Thereby, a plurality of compression chambers 9 isolated from each other by the scroll lap 7*a* and the scroll lap 8*a* are provided between the orbiting scroll 7 and the fixed scroll 8.

One of ends of the rotary shaft 5 is rotatably supported by the frame 4 and the power conversion mechanism 6, and the other is rotatably supported by the sub-frame 10. The sub-frame 10 is fixed to the container 1. It should be noted that in FIG. 1, depiction of the position and detailed connection configuration of the rotary shaft 5, the frame 4, and the power conversion mechanism 6 is omitted. Also, in FIG. 1, depiction of the position and detailed connection configuration of the rotary shaft 5 and sub-frame 10 is omitted.

A rotor 11 of the electric motor mechanism 40 is attached between one end of the rotary shaft 5 and the other end thereof. A stator 12 of the electric motor mechanism 40 is provided in such a way as to cover an outer periphery of the rotor 11, and the stator 12 is attached to the container 1.

The container 1 has a lower portion 1*a* formed in the shape of a cylinder having a bottom, a cylindrical side surface portion 1*b* and an upper portion 1*c* formed in the shape of a cylinder having a bottom; that is, these three portions are jointed to each other to form the container 1. A suction pipe 2 for suctioning low-pressure refrigerant from the outside is attached to the side surface portion 1*b* of the container 1, and a discharge pipe 3 for discharging the refrigerant compressed to high pressure is attached to the upper portion 1*c* of the container 1. Inner space of the container 1 is divided by the frame 4 into a suction space adjoining the suction pipe 2 and a discharge space adjoining the discharge pipe 3, and the electric motor mechanism 40 is provided in the suction space. In addition, the compressor 100 is of a low-pressure shell type in which the container 1 is filled with refrigerant which is still not compressed by the compression mechanism 30.

An oil reservoir 16 which stores the oil is provided at a bottom portion of the container 1. An oil pump 18 which draws up oil stored in the oil reservoir 16 is provided at an end portion of the rotary shaft 5 that adjoins the sub-frame 10. An oil supply pipe 17 extending toward the oil reservoir 16 is connected to the oil pump 18, such that a suction port 17*a* of the oil supply pipe 17 is soaked in the oil in the oil reservoir 16. The oil pump 18 draws up the oil in the oil reservoir 16 through the oil supply pipe 17, and supplies the oil to each of sliding portions through an oil supply conduit 13 formed in the rotary shaft 5.

It should be noted that since the level of an oil surface 16*a* of oil in the oil reservoir 16 varies in accordance with the usage environment and operating conditions, the level of the suction port 17*a* is adjusted such that the suction port 17*a* is not located in the oil, under all the conditions, in order to prevent interruption of oil supply. Although in embodiment 1, the oil pump 18 is provided at an end portion of the rotary shaft 5 that adjoins the sub-frame 10, the oil pump 18 may be provided at an end portion of the rotary shaft 5 which adjoins the frame 4. In addition, various pumps having different structures can be employed as the oil pump 18.

In the container 1, an oil separation space 19 is provided between the frame 4 and the electric motor mechanism 40, as space for separating the oil from the refrigerant having flowed into the compressor 100 through the suction pipe 2. The suction pipe 2 is connected to part of the side surface portion 1*b* of the container 1 that is located between the frame 4 and the electric motor mechanism 40, to cause the refrigerant gas having flowed from the outside to flow into the oil separation space 19. The frame 4 is provided with a suction port 14 as a flow passage in which the refrigerant flows from the oil separation space 19 to the compression chambers 9; and the oil is separated from the refrigerant having flowed into the oil separation space 19 through the suction pipe 2, and then the refrigerant from which the oil has been separated flows into the compression chambers 9 through the suction port 14.

It will be described how to determine the position of each of the suction pipe 2 and the suction port 14. The positions of the suction pipe 2 and the suction port 14 are determined so as to decrease the number oil droplets which have flied off from the oil surface 16*a* and would be carried into the suction port 14 by the refrigerant gas flowing above the oil reservoir 16, which will be described later. More specifically, it is appropriate to assume an operation condition under which the oil surface 16*a* of the oil in the oil reservoir 16 is located at the highest level in the case where the compressor 100 is operated in an acceptable operation range thereof, and set the levels of the suction pipe 2 and the suction port 14 to levels higher than by a specific distance or more in the direction of gravity the level of the oil surface 16*a* which is located when the compressor 100 is operated under the above operation condition.

For example, in the case where liquefied refrigerant gas flows into the compressor 100, for example, when an operation of the compressor 100 is in the stopped state, the level of the oil surface 16*a* is raised by the liquefied refrigerant gas. Therefore, it is appropriate that the levels of the suction pipe 2 and the suction port 14 are higher than the level of the oil surface 16*a* in the direction of gravity, in consideration of the case where the level of the oil surface 16*a* in the oil reservoir 16 reaches the highest level in the direction of gravity when the operation of the compressor 100 is in the stopped state. In the case where refrigerant liquid stays in the suction pipe 2 while the operation of the compressor 100 is in the stopped state, the refrigerant liquid flows into the compressor 100 after the compressor 100 is started. Then, the refrigerant liquid having flowed into the compressor 100 strikes the oil surface 16*a* of the oil in the oil reservoir 16, thus disturbing the oil surface 16*a*, as a result of which oil droplets fly off from the oil surface 16*a*, and a large amount of oil flow into the suction port 14. In view of this, it is appropriate that the suction pipe 2 is connected to the compressor 100 in order to prevent refrigerant liquid from staying in the suction pipe 2 when the operation of the compressor 100 is in the stopped state.

As described above, in consideration of the conditions required for the positions of the suction pipe 2 and the suction port 14, in the embodiment of the present invention, each of the suction pipe 2 and the suction port 14 is provided at a position which is higher than or the same as the level of the rotary shaft 5 as viewed in a rotation axial direction of the rotary shaft 5.

In the compressor 100 having the above configuration, when power is supplied to the electric motor mechanism 40, a torque is given to the rotor 11 to rotate the rotary shaft 5, and the orbiting scroll 7 orbits with respect to the fixed scroll 8. As a result, the refrigerant is compressed in the compression chambers 9. In this process, oil flows along with low-pressure refrigerant into the oil separation space 19 in the container 1 through the suction pipe 2. Part of the oil having flowed into the oil separation space 19 drops because of its own weight and is accumulated in the oil reservoir 16, and the remaining oil and the oil having flied from the oil reservoir 16 flow along with the refrigerant into the compression chambers 9 through the suction port 14.

The refrigerant containing the oil having flowed into the compression chambers 9 is compressed, and discharged from the discharge pipe 3 to the outside of the compressor through a discharge port 8*b* provided in the fixed scroll 8. The oil accumulated in the oil reservoir 16 is sucked by the oil pump 18 through the suction port 17*a* of the oil supply pipe 17, and supplied to each of the sliding portions in the compressor 100, such as the power conversion mechanism 6, through the oil supply conduit 13. Thereby, the sliding portions in the compressor 100 are lubricated, thereby preventing each sliding portion from being subject to seizure. The oil having lubricated the sliding portions is returned to the oil reservoir 16 through respective predetermined lubrication passages.

During the operation of the compressor 100 as described above, the oil is accumulated in the bottom portion in the container 1 of the compressor 100, and when the amount of the oil exceeds a predetermined amount, the oil also flows into a lower region of the oil separation space 19 which is located on a lower side in the direction of gravity, as illustrated in FIG. 1. When the oil is thus accumulated in the lower region of the oil separation space 19, the refrigerant gas which flows into the container 1 through the suction pipe 2 comes into contact with the oil surface 16*a* of the oil in the oil reservoir 16, and disturbs the oil surface 16*a*, as a result of which oil droplets fly off from the oil surface 16*a*. Then, the oil droplets having flied off from the oil surface 16*a* are sucked along with the flowing refrigerant gas into the suction port 14 to enter the compression chambers 9, and is discharged to the outside of the compressors. As a result, the amount of oil stored in the compressors is decreased, and the oil dries up, and lubrication cannot be performed.

In embodiment 1, in order to avoid occurrence of such a problem as described above, a rib 20 is provided at the frame 4 as a resisting element which can prevent flying oil from flowing into the suction port 14. The rib 20 is formed on an annular frame surface 4*a* which is perpendicular to the rotary shaft 5 at an outer surface of the frame 4 which adjoins the oil separation space 19, such that the rib 20 extends from a center portion of the frame surface 4*a* in a radial direction from the rotary shaft 5. The rib 20 may extend to contact the side surface portion 1*b* of the container 1 or may extend without contacting the side surface portion 1*b* of the container 1, with a small gap provided between the side surface portion 1*b* and the rib 20. In embodiment 1, the rib 20 extends to the side surface portion 1*b* of the container 1. In addition, the rib 20 may radially and linearly extend, or extend curvedly or in a stepwise manner. Alternatively, the rib 20 may include a plurality of small ribs which are intermittently provided. It should be noted that an end portion of the rib 20 which adjoins the rotary shaft 5 is connected to or is in contact with the outer surface of a recess 4*b* recessed toward the electric motor mechanism 40 at the center portion of the frame 4. In embodiment 1, the rib 20 is connected to the outer surface of the recess 4*b*. Also, it should be noted that "connect" means that the rib 20 is formed integrally with the recess 4*b*, or the rib 20 is joined to the outer surface of the recess 4*b*.

Next, a flow passage in which the refrigerant gas having flowed into the container 1 through the suction pipe 2 flows through the oil separation space 19 and reaches the suction port 14 will be described.

Figure 2:
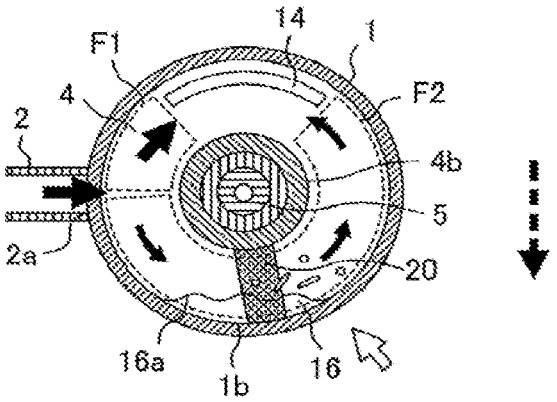
FIG. 2 is a schematic cross-sectional view along line A-A in FIG. 1.

FIG. 2 is a schematic cross-sectional view taken along line A-A in FIG. 1. In FIG. 2, solid arrows indicate flows of the refrigerant gas, and a dashed arrow indicates the direction of gravity. FIG. 2 is different from FIG. 1 in the position of the suction pipe 2 in the circumferential direction of the rotary shaft 5. FIG. 1 is a view for indicating that the suction pipe 2 is connected to the container 1 to communicate with the oil separation space 19, and it is assumed that FIG. 2 indicates the correct position of the suction pipe 2 in the circumferential direction.

The refrigerant gas having flowed into the container 1 through the suction pipe 2 is separated from the oil in the oil separation space 19, and then sucked into the suction port 14. Flow passages used at this time are a flow passage F1 and a flow passage F2 as illustrated in FIG. 2. The flow passage F1 is a flow passage which allows the refrigerant to flow from a connection port 2*a* of the suction pipe 2, which connects with the container 1, to the suction port 14 after the refrigerant gas flows toward an upper side in the direction of gravity, and corresponds to "second flow passage" of the present invention. The flow passage F2 is a flow passage which allows the refrigerant to flow from the connection port 2*a* of the suction pipe 2 which connects with the container 1 to the suction port 14 after the refrigerant gas flows toward a lower side in the direction of gravity, and corresponds to "first flow passage" of the present invention. The rib 20 is provided in the flow passage F2, and a distal end portion of the rib 20 is soaked in the oil in the oil reservoir 16.

Next, an advantage of the rib 20 will be described with reference to FIGS. 3 and 4.

Figure 3:
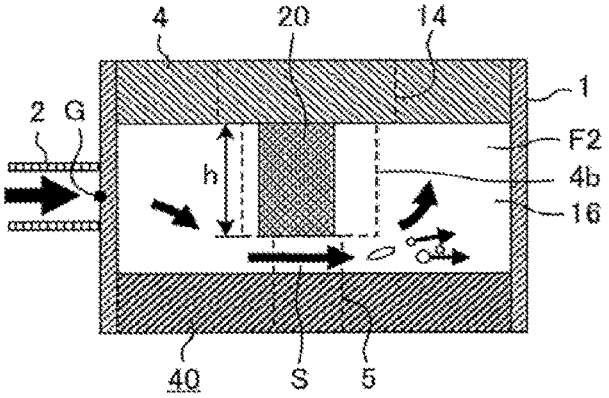
FIG. 3 is a schematic opened-up view illustrating an internal portion of the compressor as seen in a direction indicated by an outlined arrow in FIG. 2.

FIG. 3 is a schematic opened-up view of an internal portion of the compressor as viewed in a direction indicated by an outlined arrow in FIG. 2. The outlined arrow indicates a position corresponding to a center rotation angle in a rotation angle range of rotation around the rotary shaft 5 in the flow passage F2. FIG. 4 is a diagram illustrating a configuration in which no rib is provided, as a comparative example associated with the configuration illustrated in FIG. 3. Three types of arrows having different thickness are indicated in each of FIGS. 3 and 4. Of these arrows, a thick arrow and medium-sized arrows indicate flows of refrigerant gas in the flow passage F2, and thin arrows indicate flows of oil droplets having flied off from the oil surface 16*a* of the oil in the oil reservoir 16. Also, dashed lines indicate the suction port 14, the recess 4*b* of the frame 4 and the rotary shaft 5. The same is true of dashed lines in opened-up views to be referred to later.

Figure 4:
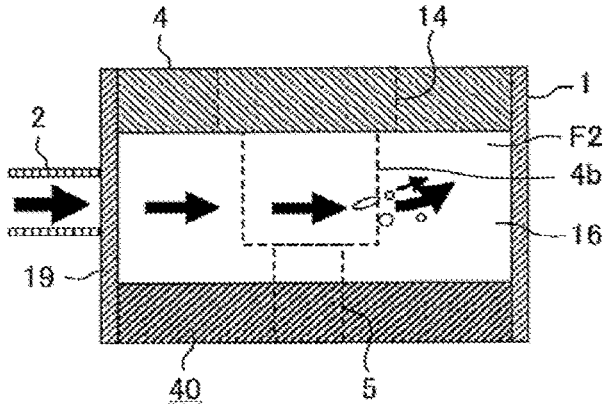
FIG. 4 is a diagram illustrating a configuration in which no rib is provided, as a comparative example associated with a configuration illustrated in FIG. 3.

In the case where the rib 20 is not provided as illustrated in FIG. 4, the flow rate of the refrigerant in the flow passage F2 is high since no resisting element is provided in the flow passage F2. When the refrigerant gas flows at a high flow rate through an area located above the oil surface 16*a*, oil droplets fly off. It should be noted that the refrigerant having flowed into the oil separation space 19 through the suction pipe 2 flows to gently deflect around the rotary shaft 5. On the refrigerant gas which deflects in such a manner, a centrifugal force acts as an outward force, but the centrifugal force is weak since the deflecting of the refrigerant gas is gentle. Thus, only a weak centrifugal force acts on the oil droplets which have flied off when the refrigerant gas flows at a high flow rate through the area located above the oil surface 16*a*, until the oil droplets are mixed up in the refrigerant gas flowing from the suction pipe 2 toward the suction port 14 and are then carried to the suction port 14. Therefore, the oil droplets flow into the suction port 14 without being separated from the flowing refrigerant gas, thus increasing the amount of discharge of oil.

On the other hand, in the case where the rib 20 is provided as illustrated in FIG. 3, the refrigerant gas having flowed into the oil separation space 19 through the suction pipe 2 strikes the oil surface 16*a* at part of the flow passage which adjoins the rib 20, as a result of which oil droplets fly off from the oil surface 16*a*. The oil droplets strike the rib 20, drop down under their own weight and are then stored in the oil reservoir 16. Furthermore, the refrigerant gas having flowed into the oil separation space 19 through the suction pipe 2 partially flows in a small gap S between the rib 20 and the electric motor mechanism 40 and flows toward the suction port 14. When the refrigerant gas flows in the gap S, the flow rate of the refrigerant gas is increased, as a result of which oil droplets easily fly off from the oil surface 16*a*. However, even if oil droplets fly off, after passing through the small gap between the rib 20 and the electric motor mechanism 40, the refrigerant gas containing the oil droplets flows into a large space, and the flow rate of the refrigerant gas is decreased, whereby the oil droplets are separated from the refrigerant gas and drop under their own weight.

Although a centrifugal force acts on the flowing refrigerant gas as an outward force, in the above case, because of provision of the rib 20, the refrigerant gas flows in such a way as to turn around the rotary shaft 5. Therefore, as compared with the case where the rib 20 is not provided, and the refrigerant gas flows to gently deflect around the rotary shaft 5, a strong centrifugal force acts on the flowing refrigerant gas, whereby the oil droplets are separated from the refrigerant gas.

By virtue of provision of the rib 20 as described above, the amount of oil droplets which enter the suction port 14 is small, as compared with the case where the rib 20 is not provided. It is therefore possible to reduce the amount of oil which is discharged to the outside of the compressor.

Next, the positional relationship between the suction pipe 2 and the rib 20 will be described below. The suction pipe 2 is connected to the container 1 such that the center G of gravity (see FIG. 3) of the connection port 2*a* in the rotation axial direction is located to fall within the range h of a length of the rib 20 in the rotation axial direction. It will be described why the positional relationship between the suction pipe 2 and the rib 20 is set in the above manner.

Figure 5:
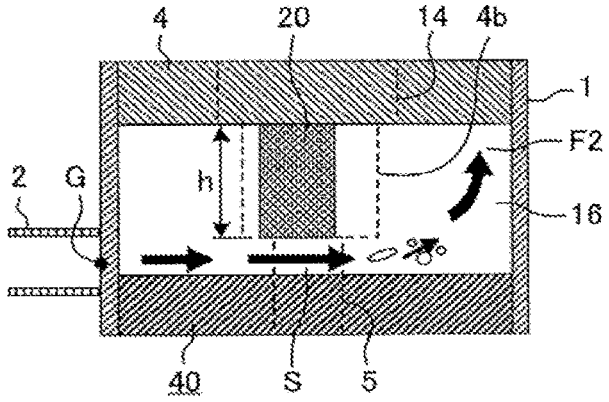
FIG. 5 is a diagram illustrating a configuration in which the center G of gravity of the connection port 2*a* in a rotation axial direction is located not to fall within the range of the length of a rib 20 in the rotation axial direction, as another comparative example associated with the configuration illustrated in FIG. 3.

FIG. 5 is a diagram illustrating a configuration in which the center G of gravity of the connection port 2*a* in the rotary shaft direction is located not to fall within the range h of the length of the rib 20 in the rotation axial direction, as a comparative example associated with the configuration of FIG. 3.

FIG. 5 illustrates a configuration in which the center G of gravity of the connection port 2*a* in the rotation axial direction is located not to fall within the range h of the length h of the rib 20 in the rotation axial direction, and, in particular, a configuration in which the center G of gravity is located to fall within the range of the height of the gap S between the rib 20 and the electric motor mechanism 40.

In the configuration as illustrated in FIG. 5, the refrigerant gas having flowed into the container 1 through the suction pipe 2 flows to pass through the gap S because the rib 20 is not provided on an extension in the flow direction of the refrigerant gas. It should be noted that in the case where no resisting element is provided on the extension, when the refrigerant gas having flowed into the container 1 through the suction pipe 2 flows in a flow passage corresponding to the shortest route, the flow rate of the refrigerant gas is increased by a dynamic pressure. Therefore, in the case where the suction pipe 2 is connected to the container 1 in such a positional relationship as illustrated in FIG. 5, the refrigerant gas having flowed into the container 1 through the suction pipe 2 passes through the gap S at a high flow rate, and oil droplets fly off from the oil surface 16*a* in the oil reservoir 16 in the flow passage. Then, the oil droplets are carried to the suction port 14, thus increasing the amount of discharge of oil.

Furthermore, in the case where the suction pipe 2 is connected to the container 1 at a position closer to the lower portion 1*a* than the position of the suction pipe 2 which is indicated in FIG. 5, that is, the suction pipe 2 is connected to the container 1 at a position closer to the lower portion 1*a* than an end portion of the electric motor mechanism 40 which adjoins the oil separation space 19, the refrigerant gas passes through space provided in the electric motor mechanism 40 to reach the suction port 14. In the case where the refrigerant gas passes through the space in the electric motor mechanism 40, oil adhering to elements defining the space and the oil stored in the oil reservoir 16 fly off, thus increasing the amount of discharge of oil.

Furthermore, in the case where the suction pipe 2 is connected to the container 1 at a position closer to the lower portion 1*a* than the end portion of the electric motor mechanism 40 which adjoins the oil separation space 19, and the container 1 is inclined, the distance between the oil surface 16*a* and the connection port 2*a* of the suction pipe 2 that connects with the container 1 is reduced. Therefore, the refrigerant gas air flow having flowed into the container through the suction pipe 2 violently disturbs the oil surface 16*a*, as a result of which the number of oil droplets flying off from the oil surface 16*a* is increased, thus increasing the amount of discharge of oil.

For the above reason, the suction pipe 2 is connected to the container 1 such that the position of the center G of gravity of the connection port 2*a* of the suction pipe 2 that connects with the container 1 is located to fall within the range h of the length of the rib 20 in the rotation axial direction.

As described above, according to embodiment 1, since the rib 20 is provided in the flow passage F2, the following advantages can be obtained. To be more specific, because of provision of the rib 20, the flow rate of the refrigerant gas which causes oil to fly off from the oil surface 16*a* id reduced, and oil having flied off from the oil reservoir 16 strikes the rib 20 and is thus separated from the flowing refrigerant gas. It is therefore possible to reduce the amount of oil which is discharged from the compressor 100 after sucked into the compression mechanism 30 through the suction port 14. Since the amount of discharge of oil can be reduced, even in the case where the compressor 100 is set to be horizontally laid or to be inclined relative to the direction of gravity, it is also possible to prevent increasing of the amount of discharge of oil which would be caused by oil droplets flying off from the oil surface 16*a* in the oil reservoir 16. Accordingly, it is possible to provide a horizontal compressor in which reduction of the amount of the oil in the oil reservoir 16 can be reduced, and shortage of the oil in the compressor can be prevented, whereby lubrication hardly fails.

Each of the connection port 2*a* and the suction port 14 is located at a position which is higher than or the same as the level of the rotary shaft 5 as viewed in the rotation axial direction, to ensure that they are separated from the oil surface 16*a* in the oil reservoir 16 in the direction of gravity. Therefore, it is possible to reduce disturbance of the oil surface 16*a* which is caused by the refrigerant gas having flowed into the container 1 through the connection port 2*a*, and reduce entrance of the liquid droplets flying off from the oil surface 16*a* into the suction port 14; that is, the liquid droplets cannot easily enter the suction port 14.

Furthermore, in embodiment 1, a simple configuration in which the rib 20 is provided at the frame 4 is provided. Therefore, it is possible to achieve a horizontal compressor which reduces increasing of the amount of discharge of oil, simply by providing the rib 20 to an existing vertical compressor in which a suction pipe 2 is made to connect with an oil separation space 19.

As a method of preventing shortage of oil in the compressor, it is also conceivable that the diameter of the container 1 is increased to increase the volume thereof for storing the oil, in addition to the method of reducing increasing of the amount of discharge of oil as in embodiment 1. However, in the case of adopting such a method, the compressor is made larger. That is, the method does not meet a recent demand for reduction of the size of the compressor.

In contrast, in the configuration of embodiment 1, it is possible to increase the amount of the oil in the oil reservoir 16, without increasing the diameter of the container 1, by reducing the amount of discharge of oil. Therefore, in the embodiment, as compared with the case where a refrigeration cycle apparatus is provided with a compressor in which the diameter of a container 1 is increased, the space for provision of the compressor 100 can be reduced, and the refrigeration cycle apparatus can be made smaller.

Furthermore, in the horizontal compressor, since part of the sub-frame 10 is soaked in the oil in the oil reservoir 16, the amount of oil to be allowed to be stored in the oil reservoir 16 is decreased by the volume of the soaked part of the sub-frame 10. Therefore, in an existing horizontal compressor, the sub-frame is made smaller in size or no sub-frame is provided, to increase the amount of oil in the oil reservoir in the container.

In contrast, in the configuration of embodiment 1, it is possible to increase the amount of the oil in the oil reservoir 16, without reducing the size of the sub-frame 10, by decreasing the amount of discharge of oil. Therefore, it is possible to ensure a support force of the rotary shaft 5 in the sub-frame 10, thus reducing the vibration of the rotary shaft 5. In such a manner, since the vibration of the rotary shaft 5 can be reduced, the rotation speed range of the rotor 11 can be increased in the case where the rotor 11 is moved at a variable speed. Therefore, the range of a refrigeration capacity of the compressor 100 which can be applied can be increased to thereby increase the output of the compressor 100.

Furthermore, in the case where the rib 20 is made to have a sufficient thickness, a supporting force of the frame 4 for the rotary shaft 5 and the compression mechanism 30 is enhanced, whereby the vibration of the rotary shaft 5 can be further reduced.

It should be noted that the configuration of the compressor of the embodiment is not limited to the above configuration; that is, it can be variously modified, for example, as described below without departing from the scope of the present invention.

Modification 1 of Embodiment 1

Figure 6:
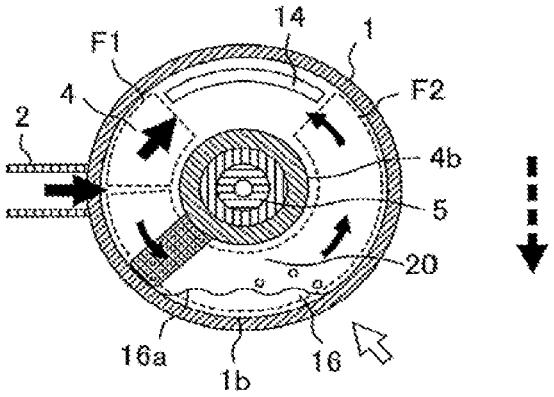
FIG. 6 is a diagram illustrating modification 1 of the compressor 100 according to embodiment 1 of the present invention.

FIG. 6 is a diagram illustrating modification 1 of the compressor 100 according to embodiment 1 of the present invention, and associated with FIG. 2 concerning embodiment 1. In FIG. 6, solid arrows indicate flows of the refrigerant gas, and a dashed arrow indicates the direction of gravity.

In modification 1, a distal end portion of the rib 20 is not soaked in the oil in the oil reservoir 16, and the rib 20 is located between the connection port 2*a* and the oil reservoir 16 in the circumferential direction in the flow passage F2.

Figure 7:
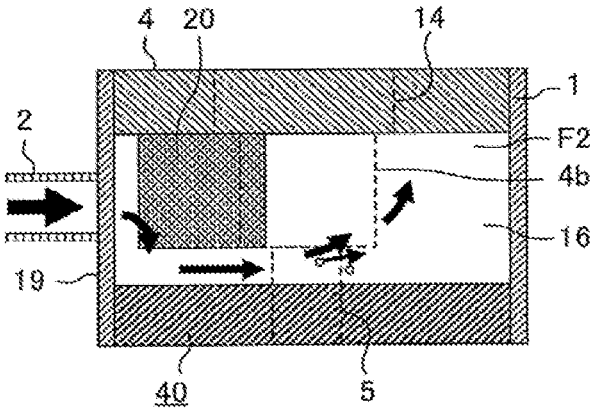
FIG. 7 is a schematic opened-up view illustrating an internal portion of the compressor as viewed in a direction indicated by an outlined arrow in FIG. 6.

FIG. 7 is a schematic opened-up view illustrating an internal portion of the compressor as viewed in a direction indicated by an outlined arrow in FIG. 6. The outlined arrow in FIG. 6 indicates a position corresponding to a center rotation angle in a rotation angle range of rotation around the rotary shaft 5 in the flow passage F2.

As illustrated in FIGS. 6 and 7, in the flow passage F2, immediately after flowing into the oil separation space 19 in the container 1 through the suction pipe 2, the refrigerant gas strikes the rib 20 and is then turned. Since a pressure loss is increased because of the turning of the refrigerant gas, the flow rate and flow velocity of the refrigerant gas flowing in the flow passage F2 from the suction pipe 2 are reduced, as compared with the case where the above configuration as illustrated in FIGS. 2 and 4 is adopted. Therefore, the number of oil droplets flying off from the oil surface 16*a* in the oil reservoir 16 is reduced.

In such a manner, even in the configuration in which the distal end portion of the rib 20 is not soaked in the oil in the oil reservoir 16, and the rib 20 is located between the suction pipe 2 and the oil reservoir 16 in the circumferential direction in the flow passage F2, it is possible to reduce the number of oil droplets which enter the suction port 14 after flying off from the oil surface 16*a* in the oil reservoir 16.

Modification 2 of Embodiment 1

Figure 8:
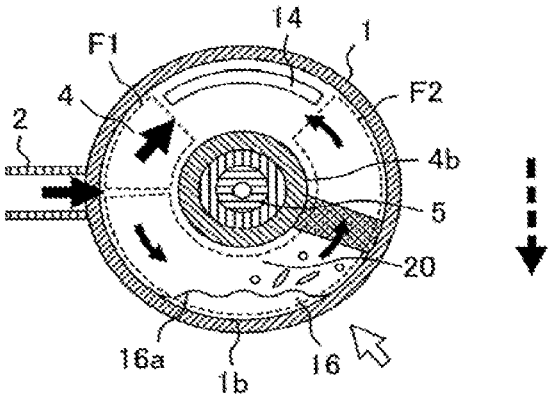
FIG. 8 is a diagram illustrating modification 2 of the compressor 100 according to embodiment 1 of the present invention.

FIG. 8 is a view illustrating modification 2 of the compressor 100 according to embodiment 1 of the present invention, and associated with FIG. 2 concerning embodiment 1. In FIG. 8, solid arrows indicate flows of the refrigerant gas, and a dashed arrow indicates the direction of gravity. Thin solid arrows indicates flows of the oil droplets having flied off from the oil surface 16*a* in the oil reservoir 16.

In modification 3, the rib 20 is not soaked in the oil in the oil reservoir 16, and the rib 20 is located between the oil reservoir 16 and the suction port 14 in the circumferential direction in the flow passage F2.

Figure 9:
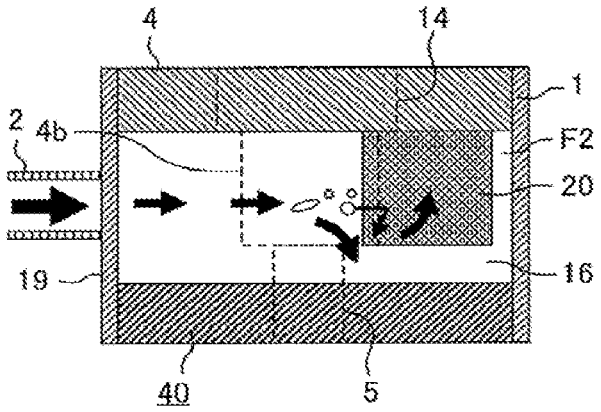
FIG. 9 is a schematic opened-up view illustrating an internal portion of the compressor as seen in a direction indicated by an outlined arrow in FIG. 8.

FIG. 9 is a schematic opened-up view illustrating an internal portion of the compressor as viewed in the direction indicated by an outlined arrow in FIG. 8. The outlined arrow in FIG. 8 indicates a position corresponding to a center rotation angle in a rotation angle range of rotation around the rotary shaft 5 in the flow passage F2.

As illustrated in FIG. 8, in the flow passage F2, the refrigerant gas passes through an area located above the oil surface 16*a* in the oil reservoir 16. Thereby, although oil droplets fly off from the oil surface 16*a* in the oil reservoir 16, the refrigerant gas containing these oil droplets strike the rib 20 as illustrated in FIG. 9. As a result, the oil droplets are separated from the refrigerant gas, and drop down under their own weight.

In such a manner, even in the configuration in which the distal end portion of the rib 20 is not soaked in the oil in the oil reservoir 16, and the rib 20 is located between the oil reservoir 16 and the suction port 14 in the circumferential direction in the flow passage F2, it is possible to reduce the amount of oil droplets which enter the suction port 14 after flying off from the oil surface 16*a* in the oil reservoir 16.

Embodiment 2

In embodiment 1, the number of ribs is one, whereas in embodiment 2, the number of ribs is two. Embodiment 2 will be described by referring mainly to the differences between embodiments 1 and 2.

Figure 10:
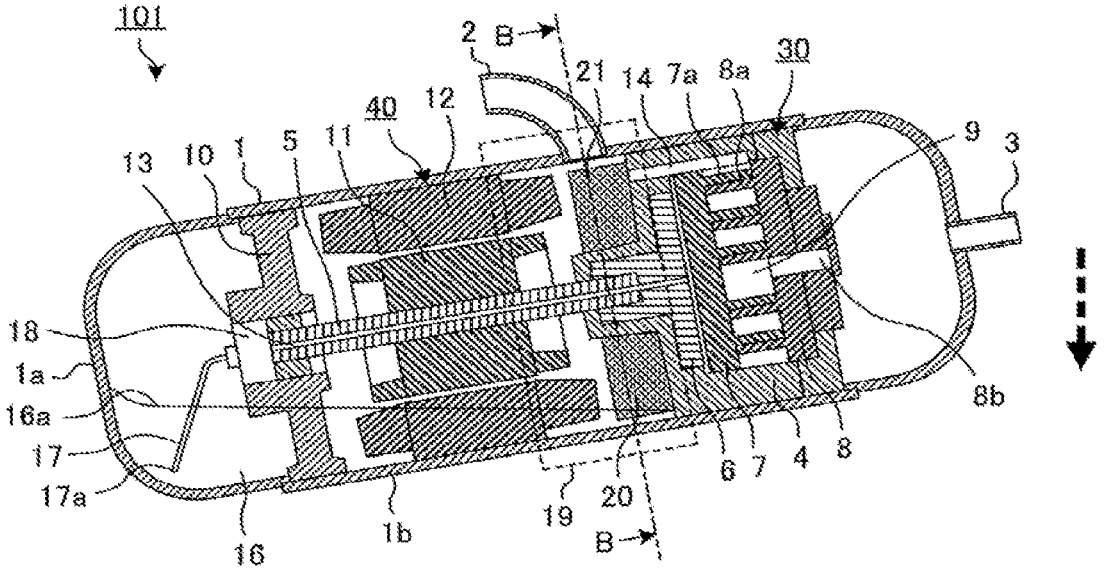
FIG. 10 is a schematic cross-sectional view illustrating a configuration of a compressor 101 according to embodiment 2 of the present invention.

FIG. 10 is a schematic cross-sectional view illustrating a configuration of a compressor 101 according to embodiment 2 of the present invention.

The compressor 101 according to embodiment 2 further includes a second rib 21 in addition to the components of the compressor 100 according to embodiment 1 as illustrated in FIG. 1. As illustrated in FIG. 10, the rib 21 is formed on an annular frame surface 4*a* of the frame 4 to radially extend from the rotary shaft 5. The rib 21 may extend to contact the side surface portion 1*b* of the container 1 or may extend to a location immediately before the side surface portion 1*b* of the container 1 such that a small gap is provided between the side surface portion 1*b* and the rib 21, as well as the rib 20. In embodiment 2, the rib 21 extends to the side surface portion 1*b* of the container 1. In addition, the rib 21 may extend linearly, or extend curvedly or in a stepwise manner, or a plurality of small ribs may be intermittently provided, as well as the rib 20.

Figure 11:
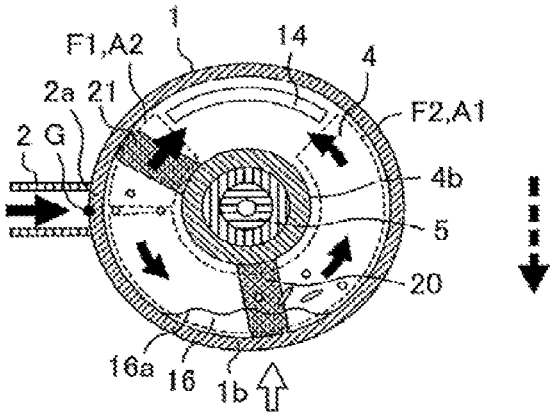
FIG. 11 is a schematic cross-sectional view taken along line B-B in FIG. 10.
Figure 12:
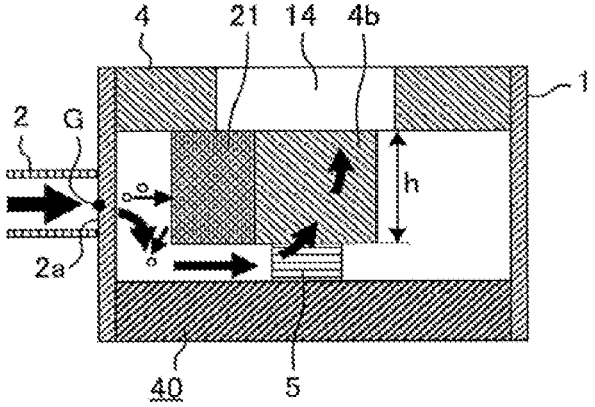
FIG. 12 is a schematic opened-up view illustrating an internal part of the compressor as seen in a direction indicated by an outlined arrow in FIG. 11, where a flow passage F1 and a suction port 14 are present.
Figure 13:
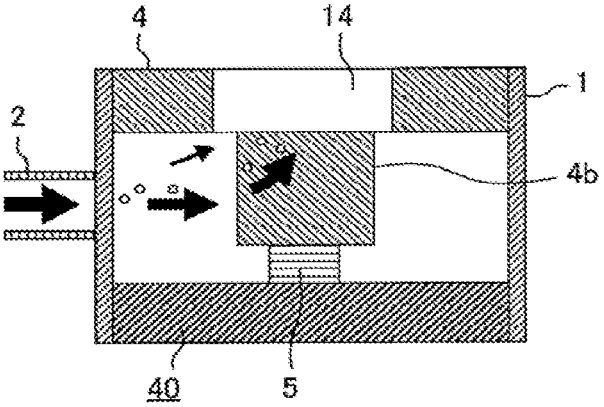
FIG. 13 is a view a configuration in which a rib 21 is not provided, as a comparative example associated with a configuration illustrated in FIG. 12.

FIG. 11 is a schematic cross-sectional view along line B-B in FIG. 10. In FIG. 11, solid arrows indicate flows of the refrigerant gas, and a dashed arrow indicates the direction of gravity. FIG. 12 is a schematic opened-up view illustrating an internal part of the compressor 1 that includes the flow passage F1 and the suction port 14 as viewed in the direction indicated by an outlined arrow in FIG. 11. The outlined arrow in FIG. 11 indicates a position of 90 degrees as the angle of rotation around the rotary shaft 5 toward the flow passage F2 from the connection port 2*a* of the suction pipe 2 to be connected to the container 1. FIG. 13 is a view which illustrates a comparative example in which the rib 21 is not provided, and is associated with FIG. 12.

As illustrated in FIG. 11, the rib 21 is provided at an intermediate portion of the flow passage F1. It is appropriate that the rib 20 is provided at any of the position of the rib 20 in embodiment 1, that of modification 1 of embodiment 1 and that of modification 2 of embodiment 1. The refrigerant gas containing oil having flowed into the container 1 through the suction pipe 2 is divided into refrigerant gas streams which will flow through the flow passage F1 and the flow passage F2. The flow of the refrigerant gas stream flowing in the flow passage F2 and the advantage of the rib 20 are the same as in embodiment 1 described above. The rib 20 and the suction pipe 2 have the same positional relationship as described above with respect to embodiment 1, and the positional relationship between the rib 21 in the flow passage F1 and the suction pipe 2 is also the same as in embodiment 1. That is, the suction pipe 2 is connected to the container 1 such that the position of the center G of gravity of the connection port 2*a* of the suction pipe 2, which connects with the container 1, is located to fall within the range of the length h of the rib 21 in the rotation axial direction, as illustrated in FIG. 12.

In the case where the rib 21 is not provided as illustrated in FIG. 13, the flow of the refrigerant gas having flowed into the flow passage F1 through the suction pipe 2 is gently deflected toward the suction port 14. Thus, only a weak centrifugal force acts on the oil droplets which flow together with the refrigerant in the flow passage F1 while flowing toward the suction port 14. Therefore, the oil may flow as it is into the suction port 14 without being separated from the refrigerant gas.

In contrast, in the case where the rib 21 is provided as illustrated in FIG. 12, the refrigerant gas containing the oil strikes the rib 21, and as a result the oil is separated from the refrigerant gas. Also, in the case where the rib 21 is provided, the refrigerant gas containing the oil is turned in such a way as to bypass the rib 21, and a strong centrifugal force thus acts on the refrigerant gas, whereby the liquid droplets are separated from the refrigerant gas. Since the oil droplets separated in such a manner drop down under their own weight, the amount of oil to be sucked into the suction port 14 can be reduced, as compared with the case where the rib 21 is not provided, and it is therefore possible to prevent increasing of the amount of discharge of oil.

As described above, according to embodiment 2, it is possible to obtain the same advantages as or similar advantages to those of embodiment 1, and further reduce the amount of oil to be discharged from the compressor 101, because of provision of the rib 21.

It should be noted that the configuration of the compressor of the embodiment of the present invention is not limited to the configuration described above. For example, it can be variously modified as described below without departing from the scope of the present invention.

Modification 1 of Embodiment 2

Figure 14:
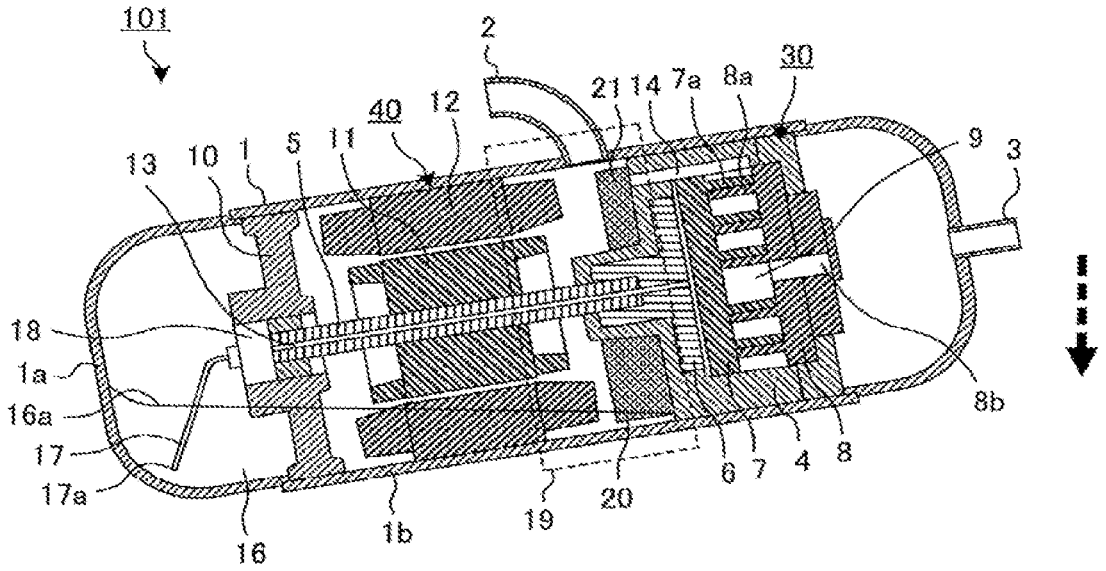
FIG. 14 is a schematic cross-sectional view illustrating a configuration of compressor 101 according to modification 1 of embodiment 2 of the present invention.

FIG. 14 is a schematic cross-sectional view illustrating a configuration of a compressor 101 according to modification 1 of embodiment 2 of the present invention. In FIG. 14, a dashed arrow indicates the direction of gravity.

In modification 1, the rib 21 of embodiment 2 in the rotation axial direction as illustrated in FIG. 10 is made to have a length different from that of the rib 20 in the rotation axial direction.

To be more specific, referring to FIG. 14, the length of the rib 21 in the rotation axial direction is made smaller than the length of the rib 20 in the rotation axial direction. In this configuration, the flow passage resistance of the rib 21 in the flow passage F1 is small, as compared with the case where the length of the rib 21 is made to be the same as that of the rib 20. Therefore, while the flow rate of the refrigerant gas flowing in the flow passage F1 is increased, the flow rate of the refrigerant gas flowing in the flow passage F2 is decreased. It is therefore possible to reduce the amount of oil which flies off from the oil surface 16*a* in the oil reservoir 16 and flows into the suction port 14.

Therefore, in the case where A1>A2, where A1 is the amount of oil which flies off from the oil surface 16*a* in the oil reservoir 16 and flows into the suction port 14, that is, the amount of oil which flows into the suction port 14 through the flow passage F2, and A2 is the amount of oil flowing into the suction port 14 through the flow passage F1, the compressor having the configuration as illustrated in FIG. 14 operates properly. That is, in the case where A1>A2, the length of the rib 21 in the rotation axial direction is made smaller than the length of the rib 20 in the rotation axial direction, the amount of discharge of oil can be further reduced.

By contrast, in the case where A1<A2, the length of the rib 21 in the rotation axial direction may be greater than the length of the rib 20 in the rotation axial direction. In this case, because of provision of the rib 21, the flow passage resistance of the flow passage F1 is increased, and the amounts of the refrigerant gas and the oil which flow in the flow passage F1 are decreased. Therefore, the amount of oil which flows from the suction pipe 2 and then flows into the suction port 14 through the flow passage F1 is decreased, thus decreasing the amount of discharge of oil.

In such a manner, the length of each of the ribs 20 and 21 in the rotation axial direction is adjusted in accordance with the relationship between the oil amount A1 and the oil amount A2, whereby increasing of the amount of discharge of oil can be prevented. Therefore, the amount of oil in the oil reservoir 16 is not decreased, thus ensuring that lubricant can be sufficient performed; that is, preventing lubricant from being insufficient.

Modification 2 of Embodiment 2

Figure 15:
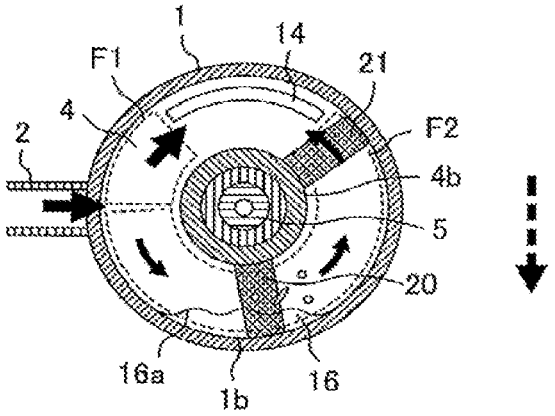
FIG. 15 is a schematic cross-sectional view (No. 1) illustrating a configuration of part of a compressor 101 according to modification 2 of embodiment 2 of the present invention, which is taken along line B-B in FIG. 10.
Figure 16:
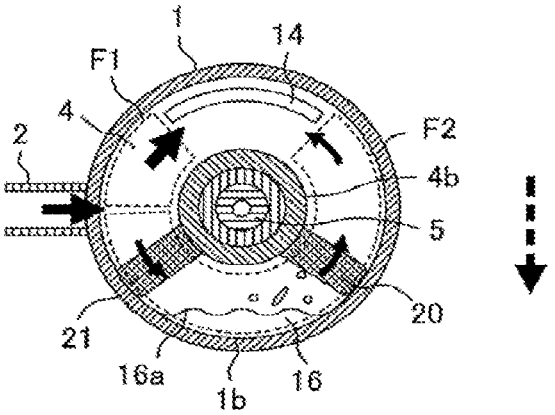
FIG. 16 is a schematic cross-sectional view (No. 2) illustrating another configuration of the part of the compressor 101 according to modification 2 of embodiment 2 of the present invention, which is taken along line B-B in FIG. 10.

FIGS. 15 and 16 are schematic cross-sectional views of part of the compressor 101 according to modification 2 of embodiment 2 of the present invention, which is taken along line B-B in FIG. 10. In FIG. 15, solid arrows indicate flows of the refrigerant gas, and a dashed arrow indicates the direction of gravity.

In embodiment 2 as illustrated in FIG. 11, the rib 21 is provided in the flow passage F1, whereas in modification 2, the rib 21 is provided in the flow passage F2. That is, in modification 2, the ribs 20 and 21 are both disposed in the flow passage F2. It should be noted that it is appropriate that the rib 20 is provided at the position described above with respect to embodiment 1, modification 1 of embodiment 1 or modification 2 of embodiment 1.

In the case where the ribs 20 and 21 are both provided in the flow passage F2, they can be disposed as illustrated in, for example, FIG. 15 or FIG. 16. To be more specific, as illustrated in FIG. 15, the rib 20 may be provided at the same position as in embodiment 1 as illustrated in FIG. 2, and the rib 21 may be disposed between the rib 20 and the suction port 14 as viewed in the rotation axial direction. Alternatively, as illustrated in FIG. 16, the rib 20 may be disposed at the same position as in modification 2 of embodiment 1 as illustrated in FIG. 8, and the rib 21 may be provided between the suction pipe 2 and the rib 20 as viewed in the rotation axial direction.

By providing the rib 21 in the flow passage F2, it is possible to reduce the number of oil droplets which flow into the suction port 14 after flying off from the oil surface 16*a* in the oil reservoir 16, as in provision of the rib 20 in embodiment 1, modification 1 of embodiment 1, or modification 2 of embodiment 1. Therefore, since the ribs 20 and 21 are disposed side by side in the flow passage F2, the flow passage resistance of the flow passage F2 is further increased, and the flow rate of the refrigerant gas passing through the flow passage F2 is reduced. Since the flow rate is reduced, the number of oil droplets flowing into the suction port 14 after flying off from the oil surface 16*a* in the oil reservoir 16 is decreased, and thus the amount of discharge of oil is further decreased.

Modification 3 of Embodiment 2

Figure 17:
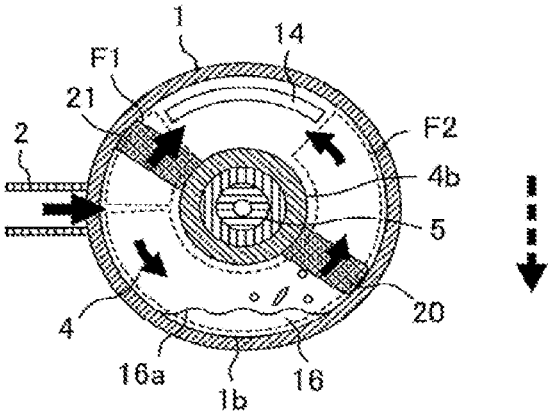
FIG. 17 is a schematic cross-sectional view (No. 1) illustrating a configuration of part of the compressor 101 according to modification 3 of embodiment 2 of the present invention, which is taken along line B-B in FIG. 10.
Figure 18:
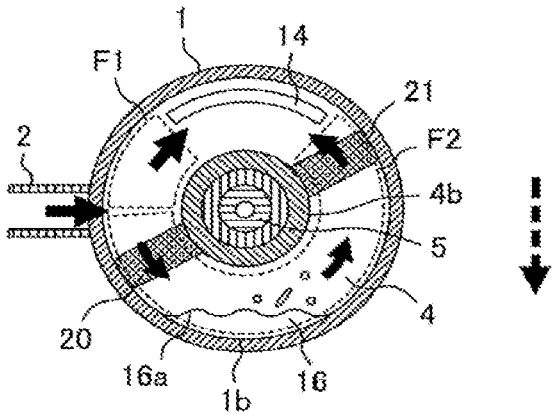
FIG. 18 is a schematic cross-sectional view (No. 2) illustrating another configuration of part of the compressor 101 according to modification 3 of embodiment 2 of the present invention, which is taken along line B-B in FIG. 10.

FIGS. 17 and 18 are schematic cross-sectional views of part of the compressor 101 according to modification 3 of embodiment 2 of the present invention, which is taken along line B-B in FIG. 10. In FIG. 17, solid arrows indicate flows of the refrigerant gas, and a dashed arrow indicates the direction of gravity.

In modification 3, the positional relationship between the ribs 20 and 21 is specified. To be more specific, the ribs 20 and 21 are disposed axial-symmetrically with respect to the rotary shaft 5. In other words, the ribs 20 and 21 are disposed in the circumferential direction of the rotary shaft 5 at equal angular intervals. It should be noted that the above axial symmetry means not only a complete axial symmetry, but a substantial axial symmetry.

In the case where the ribs 20 and 21 are disposed axial-symmetrically with respect to the rotary shaft 5, they can be as illustrated in, specifically FIG. 17 or FIG. 18. To be more specific, as illustrated in FIG. 17, the rib 21 and the rib 20 may be disposed in the flow passage F1 and the flow passage F2, respectively. Alternatively, as illustrated in FIG. 18, the rib 21 and the rib 20 may be both disposed in the flow passage F2.

In the above configuration, since a support force of the frame 4 for supporting the rotary shaft 5 and the power conversion mechanism 6 can be dispersed by the ribs 20 and 21, axial-symmetrically with respect to the rotary shaft 5, the vibration of the rotary shaft 5 can be further reduced.

Embodiment 3

In embodiments 1 and 2, the number of ribs is one or two, whereas in embodiment 3, the number of ribs is n (n≥3).

Embodiment 3 will be described by referring mainly to differences between embodiment 3 and embodiments 1 and 2.

Figure 19:
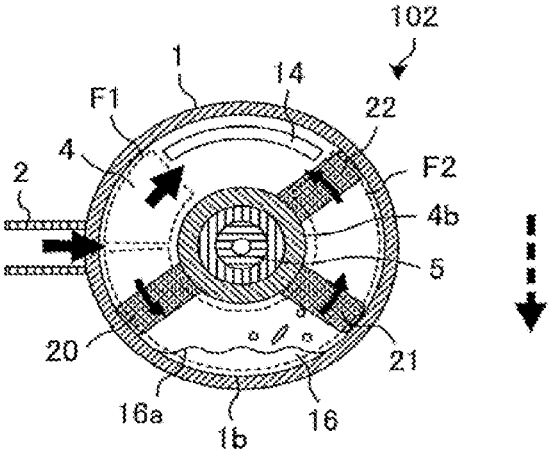
FIG. 19 is a schematic cross-sectional view illustrating a configuration of part of a compressor 102 according to embodiment 3 of the present invention, which is taken along line A-A in FIG. 1.

FIG. 19 is a schematic cross-sectional view of part of a compressor 102 according to embodiment 3 of the present invention, which is taken along line A-A in FIG. 1.

The compressor 102 of embodiment 3 further includes a third rib 22 in addition to the components of the compressor 101 of embodiment 2. As illustrated in FIG. 19, the rib 22 is provided on an annular frame surface 4*a* to extend from a center portion of the frame surface 4*a* in a radiation direction from the rotary shaft 5. The rib 22 may extend to contact the side surface portion 1*b* of the container 1, or may extend to a location immediately before the side surface portion 1*b* of the container 1, with a small gap provided between the side surface portion 1*b* and the rib 22, as well as the ribs 20 and 21. In embodiment 3, the rib 22 extends to the side surface portion 1*b* of the container 1. Furthermore, the rib 22 may extend linearly, curved or in a stepwise manner. In embodiment 3, the number of ribs is three in total; however, it may be four or more.

FIG. 19 illustrates a configuration in which the ribs 20 to 22 are provided in the flow passage F2. In such a configuration, the three ribs 20 to 23 serve as resisting elements for the flow, whereby the amount of refrigerant gas flowing in the flow passage F2 is decreased, thus reducing the number of oil droplets which fly off from the oil surface 16*a* in the oil reservoir 16. Furthermore, the refrigerant gas strikes the ribs 20 to 22 in the flow passage F2, whereby the oil droplets are more frequently separated from the refrigerant gas. It is therefore possible to further reduce the number of oil droplets which enter the suction port 14 after flying off from the oil surface 16*a* in the oil reservoir 16.

In such a configuration, the ribs 20 to 23 serve as resisting elements for the flow, whereby the amount of refrigerant gas flowing in the flow passage F2 is decreased, and the number of oil droplets flying off from the oil surface 16*a* in the oil reservoir 16 can be decreased. The refrigerant gas strikes the ribs 20 to 22 in the flow passage F2, as a result of which oil droplets are more frequently separated from the refrigerant gas, thereby the number of oil droplets which flow into the suction port 14 after flying off from the oil surface 16*a* in the oil reservoir 16 can be further reduced.

As described above, according to embodiment 3, it is possible to obtain the same advantages as or similar advantages to those of embodiments 1 and 2, and further reduce the amount of oil to be discharged from the compressor 102 because of provision of the rib 22.

The configuration of the compressor of the embodiment is not limited to such a configuration as described above. For example, it can be variously modified as described below without departing from the scope of the present invention.

Modification 1 of Embodiment 3

Figure 20:
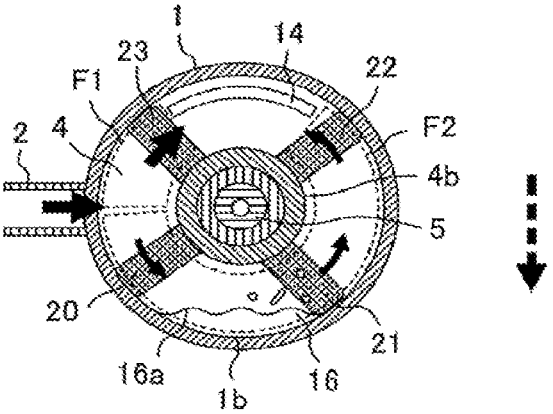
FIG. 20 is a diagram illustrating a configuration in modification 1 of the compressor 102 according to embodiment 3 of the present invention.

FIG. 20 is a view illustrating modification 1 of the compressor 102 according to embodiment 3 of the present invention.

Although referring to FIG. 19, n ribs (n≥3) are provided in the flow passage F2 only, the ribs may be provided in the flow passage F1 and the flow passage F2, as illustrated in FIG. 20. That is, in modification 1, the ribs 20 to 22 are provided in the flow passage F2, and a fourth rib, i.e., a rib 23, is provided in the flow passage F1.

In such a configuration, as illustrated in FIG. 19, because of provision of the three ribs 20 to 22 in the flow passage F2, the oil droplets can be more frequently separated from the refrigerant gas, and the amount of oil flowing into the suction port 14 after flying off from the oil surface 16*a* in the oil reservoir 16 can be reduced. Furthermore, because of provision of the rib 23 in the flow passage F1, the oil droplets flowing in the flow passage F1 strike the rib 23 and are separated from the refrigerant gas, and the number of oil droplets which enters the suction port 14 is thus decreased, as described with respect to embodiment 2. As described above, in the case where n ribs (n≥3) are provided, any of them is also provided in the flow passage F1, whereby the amount of oil to be discharged from the compressor 102 can be further decreased.

It should be noted that in the case of determining the number of ribs to be provided in each of the flow passage F1 and the flow passage F2, it is appropriate that the number is determined based on the relationship between the amount A1 of oil which flows into the suction port 14 after flying off from the oil surface 16*a* in the oil reservoir 16, that is, the amount A1 of oil which flows into the suction port 14 through the flow passage F2, and the amount A2 of oil which flows into the suction port 14 through the flow passage F1. That is, in the case where A1>A2, it is appropriate that the ribs are provided such that the number of ribs provided in the flow passage F2 is larger than that of ribs provided in the flow passage F1. By contrast, in the case where A1<A2, it is appropriate the that ribs are provided such that the number of ribs provided in the flow passage F2 is smaller than that of ribs in the flow passage F1.

Modification 1 of Embodiment 3

In modification 1, the number n (n≥3) of ribs and the thickness of each of the ribs are determined such that the distance between any adjacent two of the ribs in the circumferential direction around the rotary shaft 5 is sufficiently great to ensure the following flow of the refrigerant gas.

To be more specific, in the case where the distance between adjacent ribs is sufficiently great, the refrigerant gas passes through the space between the ribs and the electric motor mechanism 40, and then flows in such a way as to spread toward the frame 4 in the rotation axial direction in space continuous with the rib located on the downstream side. The refrigerant gas having flowed to spread toward the frame 4 in the rotation axial direction strikes the rib located on the downstream side, whereby the oil droplets are separated from the refrigerant gas. However, in the case where the distance between the adjacent ribs is small, the refrigerant gas flows in the space between the rib located on the downstream side and the electric motor mechanism 40 before the refrigerant gas spreads toward the frame 4 in the rotation axial direction. That is, the refrigerant gas flows without striking the rib, and as a result the number of oil droplets separated from the refrigerant gas is decreased.

The number n (n≥3) of ribs and the thickness of each rib are determined in consideration of the above, whereby the discharge amount of oil can be effectively decreased.

Modification 2 of Embodiment 3

In modification 2, n ribs (n≥3) are disposed at equal angular intervals in the circumferential direction around the rotary shaft 5.

In this configuration, since a support force of the frame 4 for the rotary shaft 5 and the power conversion mechanism 6 can be dispersed by each of the ribs, axial-symmetrically with respect to the rotary shaft 5, the vibration of the rotary shaft 5 can be further reduced.

Embodiment 4

In embodiments 1 to 3, the number of suction ports 14 is one, whereas in embodiment 4, the number of suction ports is m (m≥2).

Figure 21:
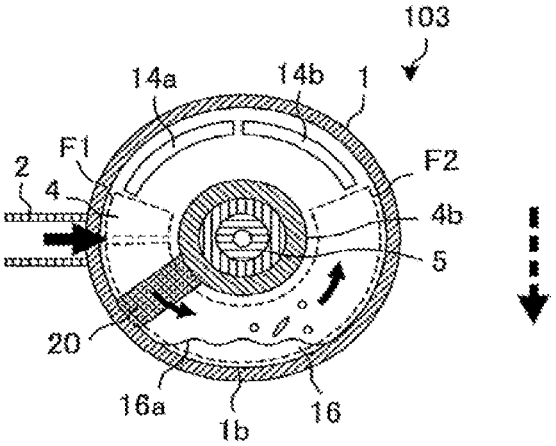
FIG. 21 is a schematic cross-sectional view illustrating a configuration of part of a compressor 103 according to embodiment 4 of the present invention, which is taken along line A-A in FIG. 1.

FIG. 21 is a schematic cross-sectional view of part of a compressor 103 according to embodiment 4 of the present invention, which is taken along line A-A in FIG. 1.

The compressor 103 according to embodiment 4 includes two suction ports 14*a* and 14*b* which are located above the frame 4 in the direction of gravity.

In such a configuration, since the total flow-passage cross-sectional area of the suction port 14*a* and the suction port 14*b* is greater than that in embodiment 1, the flow rate of the refrigerant gas which flows into each of the suction ports 14*a* and 14*b* is reduced, thereby also reducing the pressure loss, and thus improving the compression efficiency.

It should be noted that although embodiments 1 to 4 are described above as separate embodiments, characteristic configurations of the embodiments and modifications thereof may be combined as appropriate to form a compressor. Furthermore, in each of embodiments 1 to 4, modifications of the same components as in the above each embodiment are also applied to those of the embodiments which are other than the above each embodiment.

As an example of such a combination, "configuration in which the length of the rib 21 in the rotation axial direction is different from that of the rib 20 in the rotation axial direction" in modification 1 of embodiment 2 as illustrated in FIG. 14 and "configuration in which n ribs (n≥3) are provided" in embodiment 3 as illustrated in FIG. 19 may be combined such that the lengths of n ribs (n≥3) in the rotation axial direction are different from each other. In this configuration also, as described regarding modification 1 of embodiment 2, the amount of oil to be discharged from the compressor 102 can be decreased by changing the ratio between the amount of refrigerant gas flowing in the flow passage F1 and that in the flow passage F2.

Figure 22:
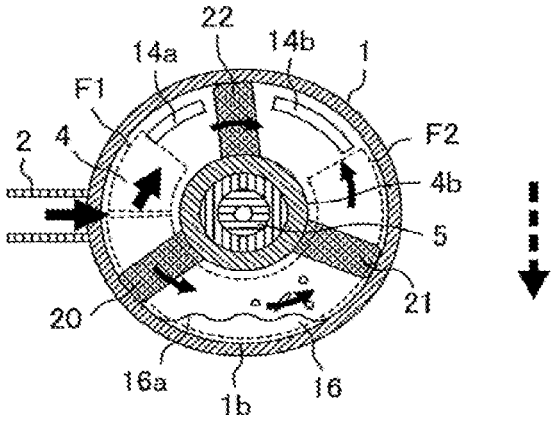
FIG. 22 is a diagram illustrating a configuration example which is a combination of embodiments and a modification.

Another example of the combination is illustrated in FIG. 22.

FIG. 22 is a diagram illustrating a configuration example obtained by combining any of the embodiments and any of the modifications.

To be more specific, FIG. 22 illustrates a configuration example obtained by combining "configuration in which a plurality of ribs are provided" in embodiment 2 as illustrated in FIG. 11, "configuration in which the plurality of ribs are disposed in the circumferential direction of the rotary shaft 5 at equal angular intervals" in modification 3 of embodiment 3 and "configuration in which a plurality of suction ports are provided" in embodiment 4 as illustrated in FIG. 21.

By virtue of the above configuration as described above, it is possible to obtain both the following advantages: the support force for supporting the rotary shaft 5 and the power conversion mechanism 6 is enhanced while reducing the amount of discharge of oil; and because the total flow passage cross-sectional area of the suction ports is increased, the pressure loss is reduced, and the compression efficiency can be improved.

In addition, for example, "configuration in which the length of the rib 21 in the rotation axial direction is made different from that of the rib 20 in the rotation axial direction" in modification 1 of embodiment 2 as illustrated in FIG. 14 may be combined with "configuration in which a plurality of suction ports are provided" in embodiment 4 as illustrated in FIG. 21.

Embodiment 5

In embodiments 1 to 4, at the frame surface 4*a* of the frame 4, the rib 20 radially extends from the rotary shaft 5, and the rib 20 is also connected to the recess 4*b* of the frame 4. In contrast, in embodiment 5, the rib 20 does not radially extend, and an end portion of the rib 20 which adjoins the rotary shaft 5 is spaced from the recess 4*b* of the frame 4 without being connected to the recess 4*b*.

Figure 23:
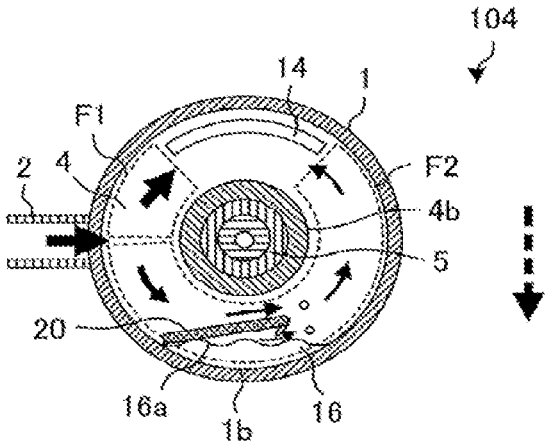
FIG. 23 is a schematic cross-sectional view (No. 1) illustrating a configuration of part of a compressor 104 according to embodiment 5 of the present invention, which is taken along line A-A in FIG. 1.
Figure 24:
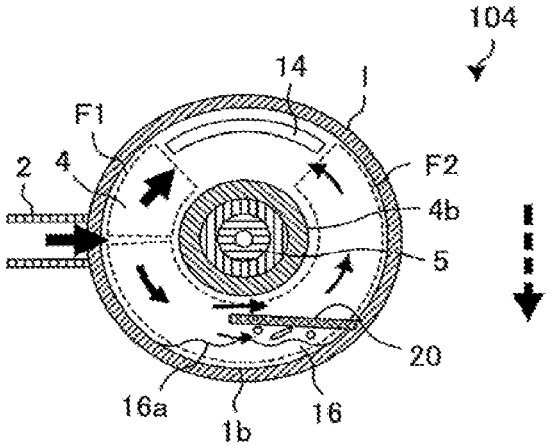
FIG. 24 is a schematic cross-sectional view (No. 2) illustrating another configuration of the part of the compressor 104 according to embodiment 5 of the present invention, which is taken along line A-A in FIG. 1.

FIGS. 23 and 24 are schematic cross-sectional views of part of a compressor 104 according to embodiment 5 of the present invention, which is taken along line A-A in FIG. 1.

In the configuration example as illustrated in FIGS. 23 and 24, the rib 20 is formed to be horizontal or inclined relative to a line extending from the center portion of the frame surface 4*a* in such a way as to radially extend from the rotary shaft 5, as viewed in the rotation axial direction, with the container 1 provided. In addition, the end portion of the rib 20 is spaced from the recess 4*b* of the frame 4 without being connected to the recess 4*b*. The rib 20 is provided above the oil surface 16*a* in the flow passage F2 and below the recess 4*b* of the frame 4, as viewed in the rotation axial direction, with the container 1 provided.

More specifically, in the configuration example as illustrated in FIG. 23, the rib 20 which is formed in the shape of a flat plate is slightly inclined relative to the horizontal direction, and is inclined upwards from the upstream side to the downstream side in the flow passage F2. In such a configuration, the refrigerant gas flowing in the flow passage F2 is gently deflected, as a result of which the amount of refrigerant gas which flows between the rib 20 and the recess 4*b* of the frame 4 is larger, and the amount of refrigerant gas which flows between the rib 20 and the oil surface 16*a* is smaller. Therefore, since the flow rate of the refrigerant gas flowing between the rib 20 and the oil surface 16*a* is reduced, the number of oil droplets which fly off from the oil surface 16*a* is reduced, and the amount of oil which flows into the suction port 14 can be reduced.

In the configuration example as illustrated in FIG. 24, the rib 20 is slightly inclined relative to the horizontal direction and downward from the upstream side to the downstream side in the flow passage F2. In such a configuration, the refrigerant gas flowing in the flow passage F2 is gently deflected, and part of the refrigerant gas flows between the rib 20 and the recess 4*b* of the frame 4 and the remaining part of the refrigerant gas flows between the rib 20 and the oil surface 16*a*. The refrigerant gas having flowed between the rib 20 and the oil surface 16*a* causes oil droplets to fly off from the oil surface 16*a*; however, the oil droplets strike the rib 20 and are separated from the refrigerant gas. Therefore, the amount of oil flowing into the suction port 14 can be reduced.

In such a manner, in the configuration as illustrated in FIGS. 23 and 24, the rib 20 does not extend from a center portion of the frame surface 4*a* in a radial direction from the rotary shaft 5, and is not connected to the recess 4*b* of the frame 4. Thus, the supporting force of the frame 4 for supporting the rotary shaft 5 and the compression mechanism 30 is not enhanced, but the amount of oil to be discharged from the compressor 104 can be decreased as in the configurations in embodiments 1 to 4. In addition, as compared with a configuration in which the rib 20 extends from the center portion of the frame surface 4*a* in the radial direction from the rotary shaft 5, the refrigerant gas can be gently deflected, and the pressure loss of the refrigerant gas flowing in the flow passage F2 is reduced, and in addition the amount of oil to be discharged from the compressor 104 can also be reduced.

Modification 1 of Embodiment 5

Figure 25:
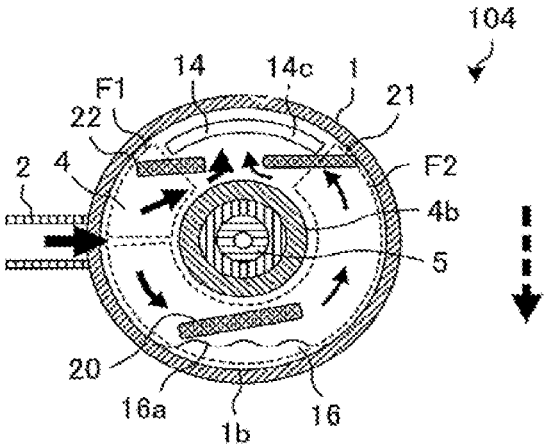
FIG. 25 is a schematic cross-sectional view illustrating a configuration of part of the compressor 104 according to modification 1 of embodiment 5 of the present invention, which is taken along line B-B in FIG. 10.

FIG. 25 is a schematic cross-sectional view of part of the compressor 104 according to modification 1 of embodiment 5 of the present invention, which is taken along line B-B in FIG. 10.

In the configuration example as illustrated in FIG. 25, the ribs 21 and 22 are provided in addition to the components as illustrated in FIG. 23, and are located in the flow passage F2 and the flow passage F1, respectively. The ribs 21 and 22, as well as the rib 20, each have an end portion spaced from the recess 4*b* of the frame 4 without being connected to the recess 4*b*. Referring to FIG. 25, the ribs 21 and 22 are formed in the flow passages F2 and F1, respectively, such that they are located in the vicinity of an inlet 14*c* of the suction port 14. To be more specific, the ribs 21 and 22 are located between an upper portion of the recess 4*b* of the frame 4 and the side surface portion 1*b* of the container 1, as seen in the rotation axial direction, with the container 1 set. The ribs 21 and 22 each correspond to a rib of the present invention which adjoins the suction port.

The rib 21 is formed on the frame surface 4*a* and inclined relative to the radial direction from the rotary shaft 5 to cause the refrigerant gas flowing in the flow passage F2 toward the suction port 14 to deflect to flow in an area closer to the recess 4*b* of the frame 4 than to the rib 21. The rib 22 is formed on the frame surface 4*a* and inclined relative to the radial direction from the rotary shaft 5 to cause the refrigerant gas flowing in the flow passage F1 toward the suction port 14 to deflect in an area adjoining the recess 4*b* of the frame 4.

In such a configuration, part of the refrigerant gas flowing in the flow passage F2 strikes the rib 21 to flow in the area adjoining the recess 4*b* of the frame 4, and is then turned to flow into the suction port 14. In this process, because of the above strikingness and a centrifugal force, the oil droplets are separated from the refrigerant gas, whereby the amount of oil flowing into the suction port 14 is decreased. Similarly, part of the refrigerant gas flowing in the flow passage F1 strikes the rib 22 to flow in the area adjoining the recess 4*b* of the frame 4, and is then turned to flow into the suction port 14. In this process, because of the above strikingness and a centrifugal force, the oil droplets are separated from the refrigerant gas, whereby the amount of oil flowing into the suction port 14 is reduced.

Furthermore, since the ribs 21 and 22 are each inclined relative to the radial direction from the center portion in a radiation direction from the rotary shaft 5, the amount of oil to be discharged from the compressor 104 can be reduced as in the configurations of embodiments 1 to 4. In addition, as compared with a configuration in which the ribs 21 and 22 extend from the center portion in the radial direction from the rotary shaft 5, the refrigerant gas can be gently deflected, and the pressure loss of the refrigerant gas flowing in the flow passage F2 or the flow passage F1 can be reduced, and in addition the amount of oil to be discharged from the compressor 104 can be reduced.

It should be noted that although it is described above that the ribs 21 and 22 are inclined relative to the radial direction from the rotary shaft 5, the ribs 21 and 22 may be laid horizontal, as viewed in the rotation axial direction, with the container 1 set. In this case also, the same advantages as described above can be obtained.

Modification 2 of Embodiment 5

Figure 26:
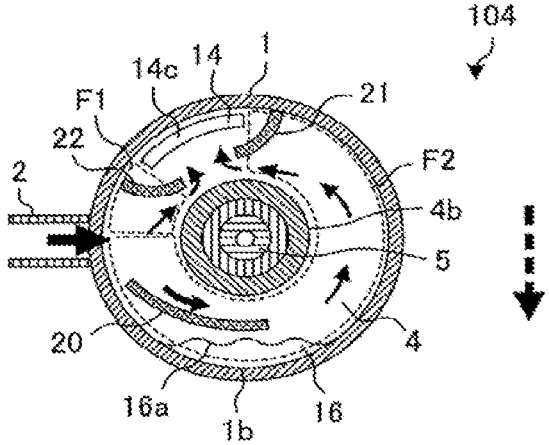
FIG. 26 is a schematic cross-sectional view illustrating a configuration of part of the compressor 104 according to modification 2 of embodiment 5 of the present invention, which is taken along line B-B in FIG. 10

FIG. 26 is a schematic cross-sectional view of the compressor 104 according to modification 2 of embodiment 5 of the present invention, which is taken along line B-B in FIG. 10.

Referring to 25, the ribs 20 to 22 are formed planar. By contrast, in modification 2, the ribs 20 to 22 are curved. The other configurations of modification 2 are the same as those illustrated in FIG. 25.

More specifically, the rib 21 is formed on the frame surface 4*a* such that part of the rib 21 which is located on the downstream side is curved in a direction along the recess 4*b*, in order to cause the refrigerant gas flowing in the flow passage F2 toward the suction port 14 to gently deflect and flow in an area adjoining the recess 4*b* of the frame 4. The rib 22 is formed on the frame surface 4*a* such that part of the rib 22 which is located on the downstream side is curved in a direction along the recess 4*b*, in order to cause the refrigerant gas flowing in the flow passage F1 toward the suction port 14 to gently deflect and flow in an area adjoining the recess 4*b* of the frame 4.

In such a configuration, it is possible to obtain the same advantages as in modification 1, and in addition the following advantages. To be more specific, part of the refrigerant gas flowing in the flow passage F2 strikes the rib 21 to flow in the area adjoining the recess 4*b* of the frame 4, and is then gently deflected to flow into the suction port 14, as compared with the case of using the rib 21 as illustrated in FIG. 25. In this process, because the refrigerant gas strikes the rib 21 and gently pass though the flow passage, the amount of oil flowing into the suction port 14 can be reduced, and the pressure loss of the refrigerant gas flowing in the flow passage F2 can also be reduced.

Similarly, part of the refrigerant gas flowing in the flow passage F1 strikes the rib 22 to flow in an area adjoining the recess 4*b* of the frame 4, and is then gently deflected to flow into the suction port 14, as compared with the case of using the rib 21 in FIG. 25. In this process, because the refrigerant gas strikes the rib 22 and gently passes through the flow passage, it is possible to reduce the amount of oil flowing into the suction ort 14, and in addition to reduce the pressure loss of the refrigerant gas flowing in the flow passage F1.

As described above, the rib 20 is also curved. That is, the rib 20 is located above the oil surface 16*a*, and is slightly inclined relative to the horizontal direction; and one of end portions of the rib 20 which is located lower than the other is located on the downstream side in the flow passage F2, and is further curved in the same direction as in the flow passage F2.

In the above configuration, since the refrigerant gas flowing in the flow passage F2 is gently deflected, a larger amount of refrigerant gas flows between the rib 20 and the recess 4*b* of the frame 4, and thus the amount of oil flowing into the suction port 14 can be reduced, and in addition the pressure loss of the flow passage F2 can also be reduced.

Figure 29:
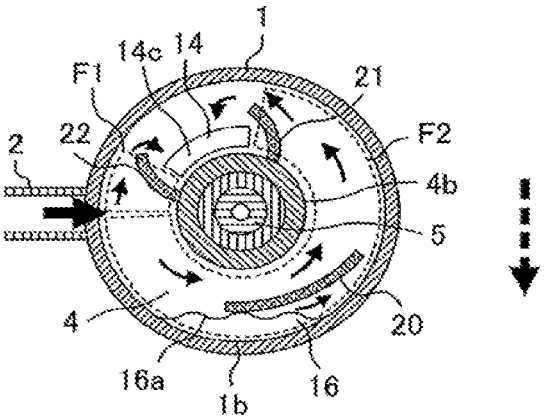
FIG. 29 is a schematic cross-sectional view illustrating another configuration of part of the compressor 105 according to modification 1 of embodiment 6 of the present invention, which is taken along line C-C in FIG. 27.

It should be noted that the configuration of the curved rib 20 is not limited to the configuration as illustrated in FIG. 26, and the curved rib 20 may have a configuration as illustrated in FIG. 29 which will be described later. To be more specific, the rib 20 is located above the oil surface 16*a*, and is slightly inclined relative to the horizontal direction, and one of the end portions of the rib 20 which is located lower than the other is located on the upstream side of the flow passage F2, and may be curved in the same direction as in the flow passage F2. In this case also, it is possible to obtain the same advantages as the rib 20 as illustrated in FIG. 26.

Embodiment 6

In embodiment 5 described above, the rib 20 is not provided to extend radially, and the end portion of the rib 20 which adjoins the rotary shaft 5 is spaced from the recess 4*b* of the frame 4 without being connected to the recess 4*b*. In contrast, although embodiment 6 is the same as embodiment 5 on the point that the rib is not provided to extend radially, an end portion of the rib in embodiment 6 which adjoins the container 1 is spaced from the side surface portion 1*b* of the container 1 without being connected to the side surface portion 1*b*.

Figure 27:
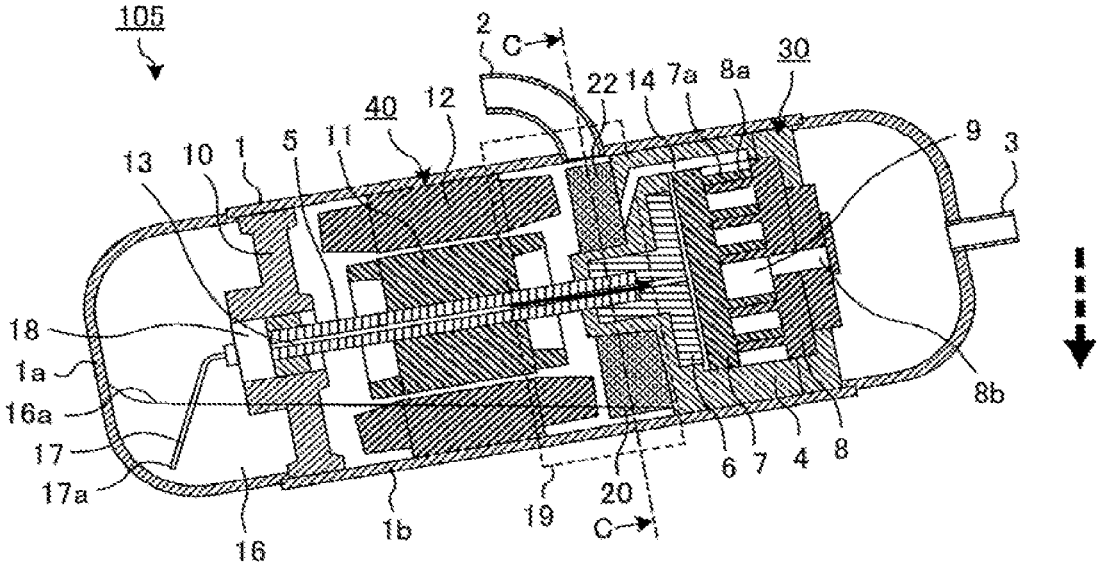
FIG. 27 is a schematic cross-sectional view illustrating a configuration of a compressor 105 according to embodiment 6 of the present invention.
Figure 28:
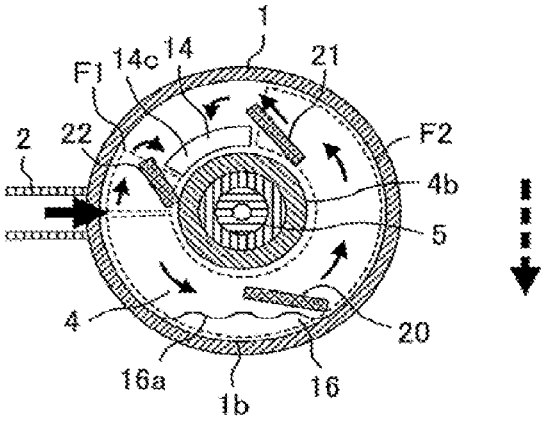
FIG. 28 is a schematic cross-sectional view illustrating a configuration of part of the compressor 105 according to embodiment 6 of the present invention, which is taken along line C-C in FIG. 27.

FIG. 27 is a schematic cross-sectional view illustrating a configuration of a compressor 105 according to embodiment 6 of the present invention. FIG. 28 is a schematic cross-sectional view of part of the compressor 105 according to embodiment 6 of the present invention, which is taken along line C-C in FIG. 27.

In the configuration example as illustrated in FIG. 28, the ribs 21 and 22 are provided in addition to the components as illustrated in FIG. 24, and are located in the flow passage F2 and the flow passage F1, respectively. The ribs 21 and 22 are each formed in the vicinity of the inlet 14*c* of the suction port 14 provided in the frame surface 4*a*. The ribs 21 and 22 are each formed on the frame surface 4*a* and inclined relative to a radial direction from the rotary shaft 5. The inlet 14*c* of the suction port 14 is located closer to the recess 4*b* than in the configuration illustrated in FIG. 24. Thus, an end portion of each of the ribs 21 and 22 that adjoins the container is relatively closer to the container than the inlet 14*c*, and is spaced from the side surface portion 1*b* of the container 1 without being connected to the side surface portion 1*b*. The ribs 21 and 22 each correspond to the rib of the present invention which adjoins the suction port.

The rib 21 is formed on the frame surface 4*a* and inclined relative to the radial direction from the rotary shaft 5, in order to cause the refrigerant gas flowing in the flow passage F2 toward the suction port 14 to deflect and flow in an area adjoining the side surface portion 1*b* of the container 1. The rib 22 is formed on the frame surface 4*a* and inclined relative to the radial direction from the rotary shaft 5, in order to cause the refrigerant gas flowing in the flow passage F1 toward the suction port 14 to deflect and flow in the area adjoining the side surface portion 1*b* of the container 1.

In such a configuration, part of refrigerant gas flowing in the flow passage F2 strikes the rib 21 to flow in the area adjoining the side surface portion 1*b* of the container 1, and is then turned to flow into the suction port 14. In this process, because of the above strikingness and a centrifugal force, oil drops are separated from the refrigerant gas, and the amount of oil flowing into the suction port 14 is thus reduced. Similarly, part of refrigerant gas flowing in the flow passage F1 strikes the rib 22 to flow in the area adjoining the side surface portion 1*b* of the container 1, and is then greatly deflected to flow into the suction port 14. In this process, because of the above strikingness and a centrifugal force, oil droplets are separated from the refrigerant gas, and the amount of oil flowing into the suction port 14 is thus reduced.

In such a manner, the ribs 21 and 22 are each inclined relative to the radial direction from the rotary shaft 5, and the amount of oil to be discharged from the compressor 104 can be reduced, as in the configurations in embodiments 1 to 4. In addition, as compared with a configuration in which the rib 21 or the rib 22 extends in the radial direction from the rotary shaft 5, the refrigerant gas can be gently deflected, and the pressure loss of the refrigerant gas flowing in the flow passage F2 or the flow passage F1 can be reduced, and in addition the amount of oil to be discharged from the compressor 104 can also be reduced.

It should be noted that although it is described above that the ribs 21 and 22 are each inclined relative to the radial direction from the rotary shaft 5, the ribs 21 and 22 may be formed to extend horizontally, as viewed in the rotation axial direction, with the container 1 set. In this case also, it is possible to obtain the same advantages as described above.

Modification 1 of Embodiment 6

FIG. 29 is a schematic cross-sectional view of part of the compressor 105 according to modification 1 of embodiment 6 of the present invention, which is taken along line C-C in FIG. 27.

Referring to FIG. 28, the ribs 20 to 22 are formed planar. By contrast, in the configuration example as illustrated in FIG. 29, the ribs 20 to 22 are curved. The other configurations of modification 1 are the same as those as illustrated in FIG. 28.

More specifically, the rib 21 is formed on the frame surface 4*a* such that part of the rib 21 which is located on the downstream side is curved in a direction along the side surface portion 1*b*, in order to cause the refrigerant gas flowing in the flow passage F2 toward the suction port 14 to gently deflect and flow in an area adjoining the side surface portion 1*b* of the container 1. The rib 22 is formed on the frame surface 4*a* such that part of the rib 22 which is located on the downstream side is curved in a direction along the side surface portion 1*b*, in order to cause the refrigerant gas flowing in the flow passage F1 toward the suction port 14 to gently deflect and flow in the area adjoining the side surface portion 1*b* side of the container 1.

In such a configuration, it is possible to obtain the following advantages, in addition to the same advantages as modification 1 described above. To be more specific, part of refrigerant gas flowing in the flow passage F2 strikes the rib 21 to flow in an area adjoining the side surface portion 1*b* of the container 1, and is then gently deflected to flow into the suction port 14, as compared with the case of using the rib 21 as illustrated in FIG. 28. In this process, because the refrigerant gas strikes the rib and gently passes through the flow passage, the pressure loss of the refrigerant gas flowing in the flow passage F2 can be reduced, and in addition the amount of oil flowing into the suction port 14 can be reduced.

Similarly, part of refrigerant gas flowing in the flow passage F1 strikes the rib 22 to flow in an area adjoining the side surface portion 1*b* of the container 1, and is then gently deflected to flow into the suction port 14, as compared with the case of using the rib 22 as illustrated in FIG. 28. In this process, because of the refrigerant gas strikes the rib and gently passes through the flow passage, the amount of oil flowing into the suction port 14 is reduced, and besides, the pressure loss of the refrigerant gas flowing in the flow passage F1 can be reduced.

In embodiments 6 and 7 as illustrated in FIGS. 25 to 29, the ribs 20 and 21 are provided in the flow passage F2, and the rib 22 is provided in the flow passage F1; however, only one of the ribs 20 and 21 may be provided as in embodiment 2. Also, as in embodiment 3 as illustrated in FIG. 19, a plurality of ribs may be provided in the flow passage F1 or the flow passage F2, and may be inclined at different angles or be curved to have different shapes. In this case, the amount of refrigerant gas flowing in each of the flow passage F1 and the flow passage F2 can be changed by adjusting the positions of the ribs, the number of the ribs, the inclination angles of the ribs, the curved shapes of the ribs, the thicknesses the ribs and the heights of the ribs, whereby the amount of discharge of oil and the pressure loss can be further reduced.

Embodiment 7

Figure 30:
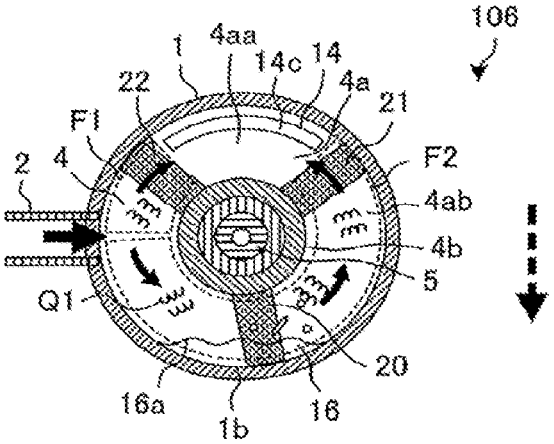
FIG. 30 is a schematic cross-sectional view illustrating a configuration of part of a compressor 106 according to embodiment 7 of the present invention, which is taken along line B-B in FIG. 10.

FIG. 30 is a schematic cross-sectional view of part of a compressor 106 according to embodiment 7 of the present invention, which is taken along line B-B in FIG. 10.

As illustrated in FIG. 30, an oil film Q1 is formed, and flows while being attached to the frame surface 4*a*. Whether it is formed or not depends on the viscosity or surface tension of the oil, the flow rate of the refrigerant gas flowing in the flow passage F1 or the flow passage F2, and the wettability of the frame surface 4*a* for the oil. The oil film Q1 is formed on the frame surface 4*a*, when the oil flowing into oil separation space 19 through the suction pipe 2 comes into contact with the frame surface 4*a*, and oil droplets having flied off from the oil surface 16*a* is brought into contact with the frame surface 4*a* by the refrigerant gas flowing in the flow passage F2. The oil film Q1 formed on the frame surface 4*a* is drawn toward the suction port 14 by a shearing force of the refrigerant gas flowing into the flow passage F1 or the flow passage F2.

Embodiment 7 relates to a configuration for preventing or reducing an increase in the discharge amount of oil, which is caused by entry of the oil film Q1 formed in the above manner into the suction port 14.

In the configuration example as illustrated in FIG. 30, the ribs 21 and 22 are provided in addition to the components of embodiment 1 as illustrated in FIG. 2, and are located in the flow passage F2 and the flow passage F1, respectively. The ribs 21 and 22 are each formed in the vicinity of the inlet 14*c* of the suction port 14, and are formed to extend in the radial direction from the rotary shaft 5, as well as the rib 20. The ribs 21 and 22 are formed to extend in the radial direction to be connected to or contact the side surface portion 1*b* of the container 1 and the recess 4*b* of the frame 4, respectively. The frame surface 4*a* is discontinuously divided by the ribs 21 and 22 into a region 4*aa* which adjoins the suction port 14 and a region 4*ab* other than the region 4*aa* without providing a gap. The ribs 21 and 22 each correspond to the rib on the suction port side of the present invention.

Figure 31:
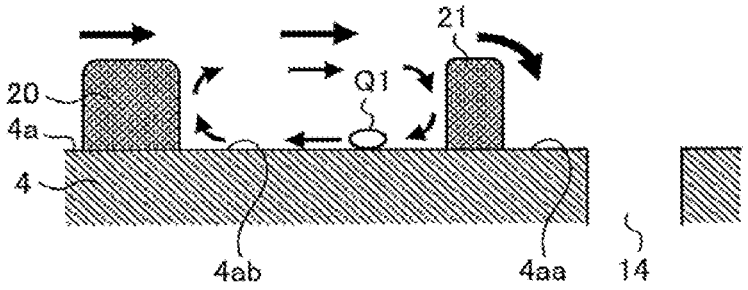
FIG. 31 is a schematic cross-sectional view illustrating a two-dimensional flow passage of the flow passage F2 in the compressor 106 as illustrated in FIG. 30.
Figure 32:
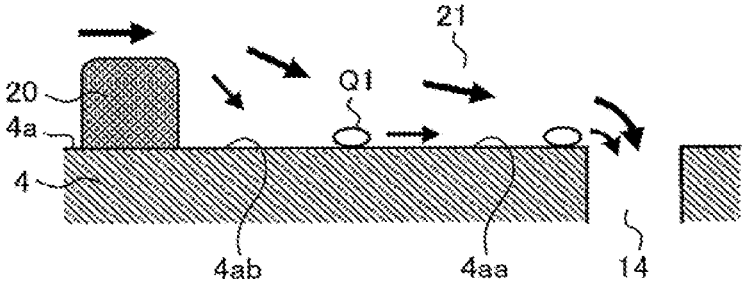
FIG. 32 is a schematic cross-sectional view illustrating the two-dimensional flow passage of the flow passage F2 in the case where a region 4*ab* and a region 4*aa* around the suction port 14 are continuously connected in the frame surface 4*a* along which the oil film Q1 flows, as a comparative example.
Figure 33:
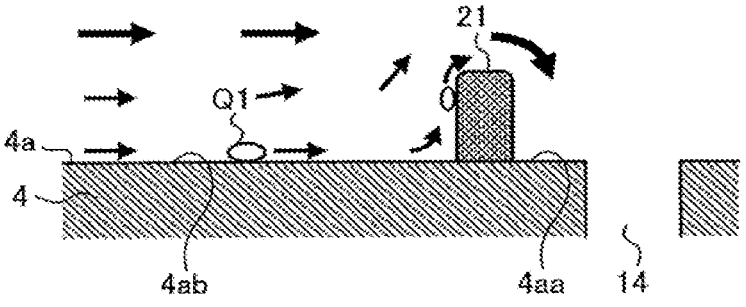
FIG. 33 is a schematic cross-sectional view illustrating the two-dimensional flow passage of the flow passage F2 in a configuration in which the rib 20 is not provided, as a comparative example.

With reference to FIG. 31 to FIG. 33, it will be described that entrance of the oil film Q1 into the suction port 14 can be reduced because of provision of the ribs 20 and 21 of FIG. 30. FIG. 31 is a schematic cross-sectional view illustrating a two-dimensional flow passage of the flow passage F2 in the compressor 106 as illustrated in FIG. 30. FIG. 32 is a schematic cross-sectional view two-dimensionally illustrating as a comparative example, a flow passage F2 in the case where the region 4*ab* and the region 4*aa* adjoining the suction port 14 are continuous with each other in the frame surface 4*a* along which the oil film Q1 flows. FIG. 33 is a schematic cross-sectional view two-dimensionally illustrating as a comparative example, the flow passage F2 in the case where the rib 20 is not provided. In FIGS. 31 to 33, thick arrows indicate flows of the refrigerant gas, and thin arrows indicate flows of the oil film Q1.

As in the comparative example as illustrated in FIG. 32, in the case where the region 4*ab* and the region 4*aa* adjoining the suction port 14 are continuous with each other at the frame surface 4*a* along which the oil film Q1 flows, the oil film Q1 flows along the frame surface 4*a*, and may flow into the suction port 14.

The refrigerant gas which flows along the frame surface 4*a* and also in the vicinity of the rib 21 flows toward the suction port 14. Thus, in the case where the rib 20 is not provided as illustrated as the comparative example in FIG. 33, part of the oil film Q1 flows along the surface of the rib 21, or is carried by the refrigerant gas after made to fly off by the rib 21 again, as a result of which the oil film Q1 may flow toward the suction port 14.

In contrast, in the case where the rib 20 is provided on the upstream side of the refrigerant flow from the rib 21 as illustrated in FIG. 31, a circulating flow is generated in the refrigerant gas in space between the ribs 20 and 21 by the shearing force of a main stream of the refrigerant gas. Therefore, the refrigerant gas flowing in the vicinity of the frame surface 4*a* flows in a substantially opposite direction to that of the flow toward the suction port 14. As a result, the amount of oil which flows along the surface of the rib 21 or which is carried by the refrigerant gas after splashed by the rib 21 again is reduced. Thus, the amount of oil flowing into the suction port 14 can be further reduced because of provision of the rib 20.

In embodiment 7, although it is described that two ribs 20 and 21 are provided in the flow passage F2, a plurality of ribs may be provided in the flow passage F2 as illustrated in FIG. 19 regarding embodiment 3. Furthermore, in the case where the amount of oil flowing into the suction port 14 through the flow passage F1 is large, the plurality of ribs may be provided in the flow passage F1.

Modification 1 of Embodiment 7

Figure 34:
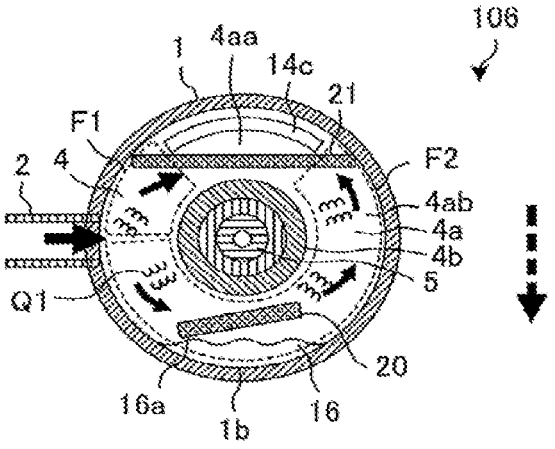
FIG. 34 is a schematic cross-sectional view illustrating a configuration of part of the compressor 106 according to modification 1 of embodiment 7 of the present invention, which is taken along line B-B in FIG. 10.

FIG. 34 is a schematic cross-sectional view of part of the compressor 106 according to modification 1 of embodiment 7 of the present invention, which is taken along line B-B in FIG. 10.

Referring to FIG. 30, the frame surface 4*a* is divided by the ribs 21 and 22 into the region 4*aa* adjoining the suction port 14 and the region 4*ab* other than the region 4*aa* without a gap. In contrast, in modification 2, one rib 21 is used. The rib 21 is formed to extend such that both ends thereof in a direction along the frame surface contact the side surface portion 1*b* of the container 1. The rib 21 corresponds to the rib of the present invention which adjoins the suction port of the present invention.

In such a configuration also, since the amount of the oil film Q1 which flows along the frame surface 4*a* and directly flows into the suction port 14 is reduced as in the configuration example as illustrated in FIG. 30, the amount of oil flowing into the suction port 14 can be reduced, and the amount of discharge of oil can be reduced.

It should be noted that although FIG. 34 illustrates a configuration in which one rib 20 is provided in the flow passage F2 in addition to the rib 21, a plurality of ribs may be provided in the flow passage F2 as illustrated in FIG. 19 regarding embodiment 3. Furthermore, in the case where the amount of oil flowing into the suction port 14 through the flow passage F1 is large, a plurality of ribs may be provided in the flow passage F1.

Modification 2 of Embodiment 7

Figure 35:
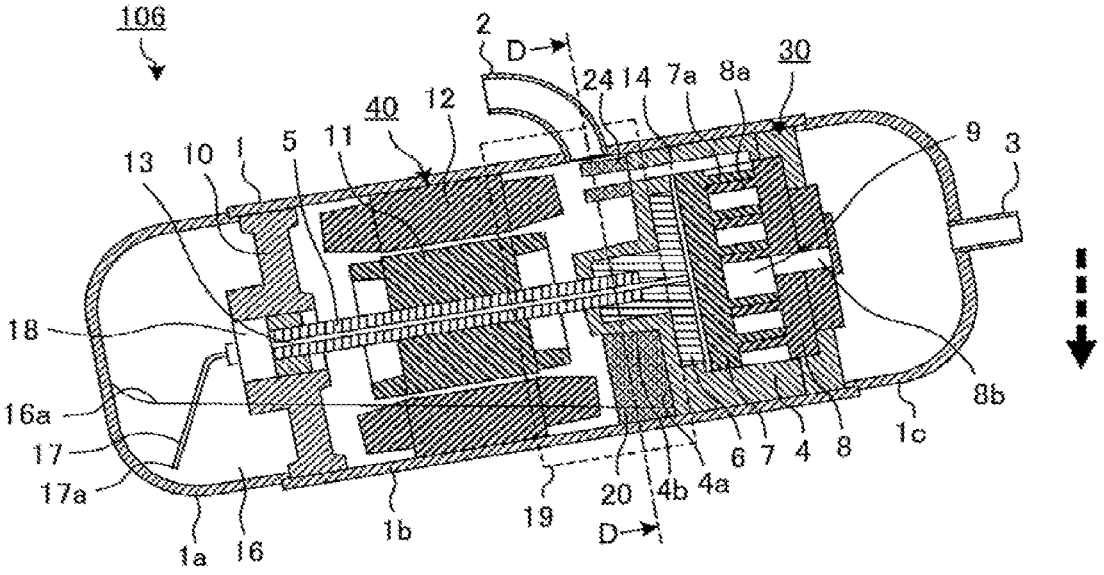
FIG. 35 is a schematic cross-sectional view illustrating a configuration of the compressor 106 according to modification 2 of embodiment 7 of the present invention.
Figure 36:
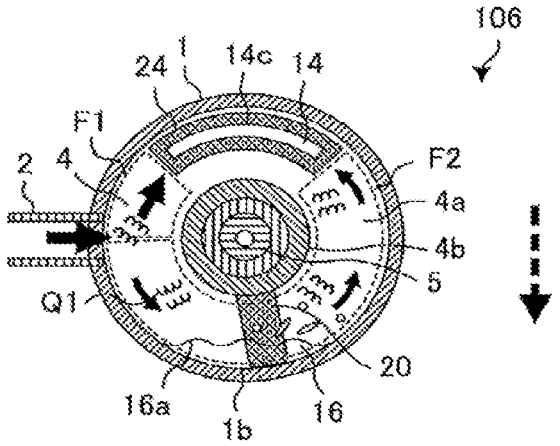
FIG. 36 is a schematic cross-sectional view illustrating a configuration of part of the compressor 106 according to modification 2 of embodiment 7 of the present invention, which is taken along line D-D in FIG. 35

FIG. 35 is a schematic cross-sectional view illustrating a configuration of the compressor 106 according to modification 2 of embodiment 7 of the present invention. FIG. 36 is a schematic cross-sectional view of the compressor 106 according to modification 2 of embodiment 7 of the present invention, which is taken along line D-D in FIG. 35.

In modification 2, a protrusion 24 is formed to extend in the rotation axial direction from the frame surface 4*a* and to surround the suction port 14.

In such a configuration also, the oil film Q1 formed on the frame surface 4*a* is prevented by the protrusion 24 from flowing toward the suction port 14 while the oil film Q1 is flowing along the frame surface 4*a*. Therefore, the amount of the oil film Q1 directly flowing into the suction port 14 is reduced, and the amount of discharge of oil can thus be reduced.

Figure 37:
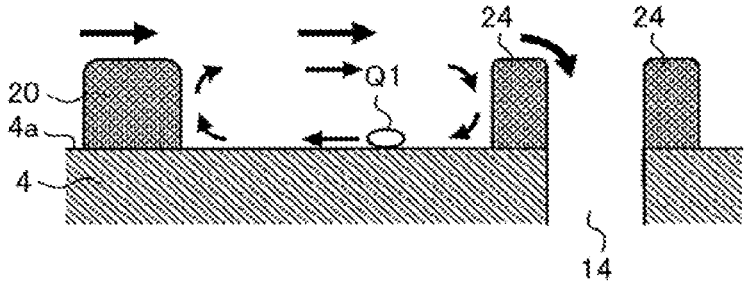
FIG. 37 is a schematic cross-sectional view illustrating a two-dimensional flow passage of the flow passage F2 in the compressor 106 as illustrated FIG. 36.
Figure 38:
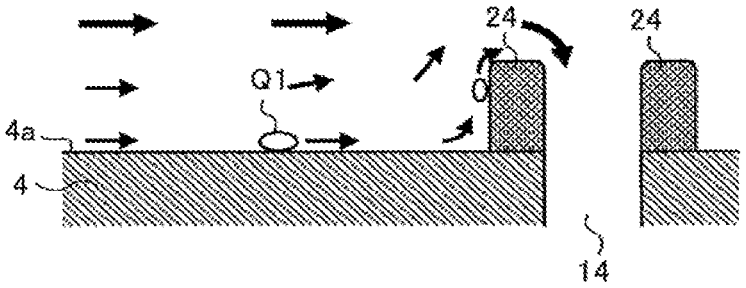
FIG. 38 is a schematic cross-sectional view illustrating the two-dimensional flow passage of the flow passage F2 in a configuration in which the rib 20 is not provided, as a comparative example.

With reference to FIGS. 37 to 38, it will be described that the oil film Q1 is prevented by the protrusion 24 from flowing into the suction port 14. FIG. 37 is a schematic cross-sectional view two-dimensionally illustrating the flow passage F2 in the compressor 106 which is provided as illustrated in FIG. 36. FIG. 38 is a schematic cross-sectional view two-dimensionally illustrating as a comparative example the flow passage F2 in the case where the rib 20 is not provided. In FIG. 37, thick arrows indicate flows of the refrigerant gas, and thin arrows indicate flows of the oil film Q1.

The refrigerant gas which flows along the frame surface 4*a* and also in the vicinity of the surface of the protrusion 24 flows toward the suction port 14. Thus, in the case where the rib 20 is not provided as illustrated as the comparative example in FIG. 38, part of the oil film Q1 flows along the surface of the protrusion 24, or is carried by the refrigerant gas after made to fly off by the protrusion 24 again, as a result of which the oil film Q1 may flow toward the suction port 14, as in the configuration as illustrated in FIG. 33.

In contrast, in the case where the protrusion 24 is provided as illustrated in FIG. 37, a circulating flow is generated in the refrigerant gas in space between the rib 20 and the protrusion 24 by the shearing force of a main stream of the refrigerant gas, and the refrigerant gas flowing in the vicinity of the frame surface 4*a* flows in a substantially opposite direction to that of the flow toward the suction port 14. As a result, the amount of oil which flows along the surface of the protrusion 24 or is carried by the refrigerant gas after made to fly off by the protrusion 24 again is reduced, and the amount of oil flowing into the suction port 14 can thus be decreased because of provision of the rib 20.

Although FIG. 36 illustrates a configuration example in which one rib 20 provided in the flow passage F2 in addition to the protrusion 24, a plurality of ribs may be provided in the flow passage F2 as in embodiment 3 as described with reference to FIG. 19. In the case where the amount of oil flowing into the suction port 14 through the flow passage F1 is large, a plurality of ribs may be provided in the flow passage F1. Furthermore, in the configuration example as illustrated in FIG. 36, one suction port 14 is provided; however, a plurality of suction port 14 may be provided in the flow passage F2 as in embodiment 4 as described with reference to FIG. 21, and it may be determined whether or not to provide a protrusion 24 for each of the suction ports 14, and if the protrusion or protrusions 24 are provided for the respective suction ports, their shapes may be individually determined.

Furthermore, a compressor may be formed by combining as appropriate, any of characteristic configurations of embodiments 1 to 4 and the modifications thereof with embodiments 5 and 6. Furthermore, a modification of each of components described with respect to each of embodiments 5 and 6 is also applicable to other embodiments each provided with any of the components.

Embodiment 8

Embodiment 8 relates to a refrigeration cycle apparatus provided with the compressor according to any of embodiments 1 to 7. In the following description, embodiment 8 is described by referring to by way of example the case where the refrigeration cycle apparatus is provided with the compressor 100 according to embodiment 1.

Figure 39:
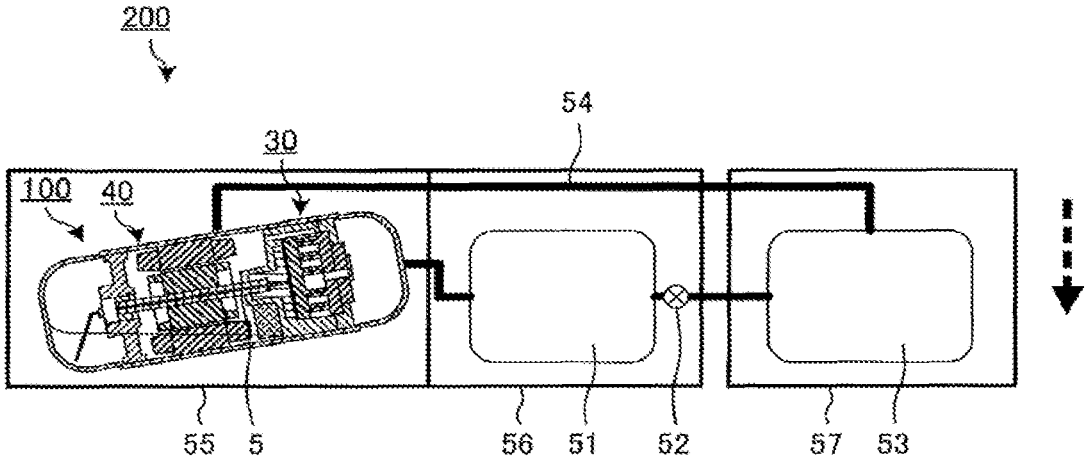
FIG. 39 is a schematic diagram of a refrigeration cycle apparatus 200 according to embodiment 8 of the present invention.

FIG. 39 is a schematic diagram of a refrigeration cycle apparatus 200 according to embodiment 8 of the present invention.

The refrigeration cycle apparatus 200 is installed, for example, in a ceiling of a building or a vehicle, or below a floor of the building or in a duct therein. The refrigeration cycle apparatus 200 includes the compressor 100, a first heat exchanger 51, an expansion device 52 including an expansion valve, a capillary tube, etc., and a second heat exchanger 53, which are connected by refrigerant pipes 54.

The refrigeration cycle apparatus 200 includes a compressor chamber 55 which houses the compressor 100 of embodiment 1, a first heat exchanger chamber 56 which houses the first heat exchanger 51, and a second heat exchanger chamber 57 which houses the second heat exchanger 53. As illustrated in FIG. 23, a casing is partitioned into the compressor chamber 55 and the first heat exchanger chamber 56, and another casing is also provided in which the second heat exchanger chamber 57 is formed. It should be noted that the way of providing those three chambers is not limited to the above way, and only one casing may be provided and partitioned into the three chambers, or three casings may be provided in which the respective chambers are formed.

The refrigeration cycle apparatus 200 may further include, as components, a first fan which advances heat exchange in the first heat exchanger 51, a second fan which advances heat exchange in the second heat exchanger 53, and a four-way valve which switches connection of the refrigerant pipe 54 between that for cooling operation and that for heating operation in the case of switching the operation between the cooling operation and the heating operation, and a controller which controls each of the components. In FIG. 23, these components are omitted.

The compressor 100 is a horizontal compressor as described above, and is installed in the compressor chamber 55, with the rotary shaft 5 inclined relative to the direction of gravity. The compressor 100 is oblong in the rotation axial direction since the compression mechanism 30 and the electric motor mechanism 40 are arranged side by side on the rotary shaft 5 as illustrated in FIG. 1. Therefore, in the case where the compressor 100 is installed to stand vertically such that the rotary shaft 5 is parallel to the direction of gravity, the height of the space for installing the compressor 100 is increased. However, the compressor 100 of embodiment 5 is installed to be horizontally laid, and hence the height of the space for installing it can be reduced. The height of the installation space can be further reduced as the rotary shaft 5 is further inclined toward a line perpendicular to the gravitation direction.

In general, it is known that in the case where the amount of oil discharged from the compressor is large, the amount of oil flowing into the heat exchanger is larger, and the oil hinders the heat transfer of the refrigerant in the heat exchanger, thus reducing the refrigeration cycle efficiency. In an existing horizontal compressor for use in the refrigeration cycle apparatus, the amount of discharge of oil is large, and the refrigeration cycle efficiency is thus liable to be reduced. However, since the refrigeration cycle apparatus 200 employs the compressor 100 which is small in the amount of discharge of oil, it can achieve a high refrigeration cycle efficiency, though the compressor is a horizontal compressor.

As described above, since the refrigeration cycle apparatus 200 employs the compressor 100, the compressor chamber 55 can be formed to have a lower height. Thus, the compressor 55 can be easily installed in space whose height is low, for example, in a ceiling of a building or a vehicle, below a floor of the building or a duct therein.

Since the compressor 100 is of a low-pressure shell type, the thickness of the container 1 is small, and the compressor 100 is small and light, as compared with a high-pressure shell type of compressor.

As described above, although the refrigeration cycle apparatus 200 employing the compressor 100 has a low height and a light weight and operates at a high efficiency, it can achieve a small amount of discharge of oil and a high air-conditioning efficiency.

Furthermore, even in the case where the compressor 100 is installed to be horizontally laid, the amount of discharge of oil can be reduced as described above. Therefore, the compressor 100 can be flexibly set such that for example, in the case where the compressor 100 is provided in a specific refrigeration cycle apparatus, it is set to stand vertically, and in the case where it is provided in another refrigeration cycle apparatus 200, the compressor 100 is set to be horizontally laid. In such a manner, it is possible to determine whether the compressor 100 should be set to stand vertically or to be laid horizontally, in accordance with what refrigeration cycle apparatus the compressor 100 is provided in. Therefore, when vertical compressors and horizontal compressors are manufactured, it is not necessary to change the specifications of each of the compressors in accordance with whether each compressor is a vertical compressor or a horizontal compressor. Thus, production facilities for manufacturing the compressors and the number of manufacturing processes of each of the compressors can be reduced.

REFERENCE SIGNS LIST

Container 1*a* Lower portion 1*b* Side face portion 1*c* Upper portion 2 Suction pipe 2*a* Connection port 3 Discharge pipe 4 Frame 4*a* Frame surface 4*b* Recess 5 Rotary shaft 6 Power conversion mechanism 7 Orbiting scroll 7*a* Scroll lap 8 Fixed scroll 8*a* Scroll lap 8*b* Discharge port 9 Compression chamber 10 Sub-frame 11 Rotor 12 Stator 13 Oil supply conduit 14 Suction port 14*a* Suction port 14*b* Suction port 14*c* Inlet 16 Oil reservoir 16*a* Oil surface 17 Oil supply pipe 17*a* Suction port 18 Oil pump 19 Oil separation space 20 Rib 21 Rib 22 Rib 23 Rib 24 Protrusion 30 Compression mechanism 40 Electric motor mechanism 51 First heat exchanger 52 Expansion device 53 Second heat exchanger 54 Refrigerant pipe 55 Compressor chamber 56 First heat exchanger chamber 57 Second heat exchanger chamber 100 Compressor 101 Compressor 102 Compressor 103 Compressor 200 Refrigeration cycle apparatus A1 Oil amount A2 Oil amount F1 Flow passage F2 flow passage Q1 Oil film G Center of gravity S Gap h Range of length

The invention claimed is:

1. A compressor comprising:

a container provided with an oil reservoir which is provided at a bottom portion of the container to allow oil to be collected in the oil reservoir;

an electric motor mechanism supported in the container;

a rotary shaft configured to receive a rotary driving force from the electric motor mechanism;

a compression mechanism provided in the container and configured to compress refrigerant by rotation of the rotary shaft;

a frame provided between the electric motor mechanism and the compression mechanism and configured to fix the compression mechanism to the container; and a suction pipe connected to the container to communicate with space between the frame and the electric motor mechanism and thus allow the refrigerant to flow into the space, the frame being provided with a suction port formed therein to allow refrigerant having flowed into the space to flow into the compression mechanism, each of a connection port of the suction pipe that connects with the container and the suction port being located at a position which is higher than or the same as a level of the rotary shaft as seen in a rotation axial direction of the rotary shaft, with the container set such that the rotary shaft is inclined relative to a direction of the gravity or is laid horizontal, a rib being provided in a first flow passage which extends downwards in the direction of gravity from the connection port, extends through an area located above the oil reservoir, and reaches the suction port, and the rib is provided such that a distal end portion of the rib is located in the oil reservoir.

2. The compressor of claim 1, wherein the suction pipe is connected to the container such that a position of a center G of gravity of the connection port in the rotation axial direction is located to fall within a range of a length of the rib in the rotation axial direction.

3. The compressor of claim 1, wherein a plurality of the ribs are provided, and dividedly provided in the first flow passage and a second flow passage which extends upwards in the direction of gravity from the connection port to the suction port.

4. The compressor of claim 3, wherein the number of those of the plurality of ribs that are provided in the first flow passage and the number of those of the plurality of ribs that are provided in the second flow passage are determined based on respective amounts of oil flowing into the suction port through the first and second flow passages, and the number of the ribs provided in one of the first and second flow passages, through which a larger amount of oil flows into the suction port, is set larger than the number of the ribs provided in the other of the first and second flow passage, through which a smaller amount of oil flows into the suction port.

5. The compressor of claim 3, wherein the plurality of ribs have different lengths in the rotation axial direction.

6. The compressor of claim 5, wherein a length of the rib or ribs in the rotation axial direction, that are provided in each of the first and second flow passages is determined based on an amount of oil flowing into the suction port through the each of the first and second flow passages, and the length of the rib or ribs in the rotation axial direction, that are provided in one of the first and second flow passages, through which a larger amount of oil flows into the suction port, is set greater than the length of the rib or ribs in the rotation axial direction, that are provided in the other of the first and second flow passages, through which a smaller amount of oil flows into the suction port.

7. The compressor of claim 3, wherein the plurality of ribs are disposed at equal angular intervals in the circumferential direction of the rotary shaft.

8. The compressor of claim 1, wherein the rib is formed on a frame surface of the frame which is an outer surface thereof that adjoins the space, and extends from a center portion of the frame surface in a radial direction from the rotation shaft.

9. The compressor of claim 1, wherein an inlet of the suction port is open to a frame surface of the frame which is the outer surface thereof that adjoins the space, one or more suction-port-side ribs are formed in vicinity of the inlet at the frame surface, and the frame surface is divided by the one or more suction-port-side ribs into an area located in the vicinity of the inlet and an area other than the area located in the vicinity of the inlet.

10. The compressor of claim 9, wherein the number of the suction-port-side ribs is two, and the suction-port-side ribs are each formed to extend from a center portion of the frame surface in a radial direction from the rotary shaft.

11. The compressor of claim 9, wherein the number of the suction-port-side ribs is one, and the suction-port-side rib extends until both ends thereof in a direction along the frame surface contact the container.

12. The compressor of claim 1, wherein a protrusion is formed on the frame surface of the frame which is the outer surface thereof that adjoins the space, and also formed to surround the inlet of the suction port which is open to the frame surface.

13. The compressor of claim 1, wherein the rib is formed on a frame surface of the frame which is the outer surface thereof that adjoins the space, and extends from a center portion of the frame surface in a radial direction from the rotary shaft, as seen in the rotation axial direction, with the container set; and an end portion of the rib which adjoins the rotary shaft is spaced from a recess which is recessed toward the electric motor mechanism at the center portion of the frame.

14. The compressor of claim 1, wherein the inlet of the suction port is open to a frame surface of the frame which is the outer surface thereof that adjoins the space, one or more suction-port-side ribs are formed in vicinity of the inlet at the frame surface, the one or more suction-port-side ribs are each formed between the inlet and a recess recessed toward the electric motor mechanism at a center portion of the frame, and extend from a center portion of the frame surface in such a way to be inclined relative to a radial direction from the rotary shaft, as seen in the rotation axial direction, with the container set, and the end portion of each of the one or more suction-port-side ribs is spaced from the recess.

15. The compressor of claim 1, wherein the inlet of the suction port is open to a frame surface of the frame which is the outer surface thereof that adjoin the space, one or more suction-port-side ribs are formed in vicinity of the inlet at the frame surface, and the one or more suction-port-side ribs are each formed between the inlet and a recess which is recessed toward the electric motor mechanism side at a center portion of the frame, and extend from a center portion of the frame surface in such a way as to be inclined relative to a radial direction from the rotary shaft, as viewed in the rotation axial direction, with the container set, and the end portion of each of the one or more suction-port-side ribs, that adjoin the suction port, is relatively closer to the container than the inlet, and is spaced from the container.

16. The compressor of claim 1, wherein the rib is formed to be curved.

17. A refrigeration cycle apparatus provided with the compressor of claim 1.

18. The compressor according to claim 1 wherein the connection port being located at a position which is lower than the suction port.

* * * * *